US010507158B2

(12) United States Patent
Brzenchek et al.

(10) Patent No.: US 10,507,158 B2
(45) Date of Patent: Dec. 17, 2019

(54) PATIENT SUPPORT APPARATUS HAVING AN INTEGRATED LIMB COMPRESSION DEVICE

(71) Applicant: Hill-Rom Services, Inc., Batesville, IN (US)

(72) Inventors: David J. Brzenchek, Harrison, OH (US); Richard J. Schuman, Sr., Cary, NC (US); Jonathan D. Turner, Dillsboro, IN (US); James L. Walke, Batesville, IN (US); Richard H. Heimbrock, Cincinnati, OH (US); Robert M. Zerhusen, Cincinnati, OH (US); Thomas M. Gillis, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 381 days.

(21) Appl. No.: 15/432,991

(22) Filed: Feb. 15, 2017

(65) Prior Publication Data

US 2017/0239131 A1 Aug. 24, 2017

Related U.S. Application Data

(60) Provisional application No. 62/296,735, filed on Feb. 18, 2016.

(51) Int. Cl.
*A61G 7/00* (2006.01)
*A61H 9/00* (2006.01)
(Continued)

(52) U.S. Cl.
CPC ..... *A61H 9/005* (2013.01); *A47C 21/042* (2013.01); *A47C 21/048* (2013.01);
(Continued)

(58) Field of Classification Search
CPC ..... A61G 7/00
(Continued)

(56) References Cited

U.S. PATENT DOCUMENTS 891,181 A 6/1908 Mitchell
RE14,681 E 7/1919 Faries
(Continued)

FOREIGN PATENT DOCUMENTS

EP 0861651 A1 9/1998
EP 0992230 A2 4/2000
(Continued)

OTHER PUBLICATIONS

European Search Report dated Jun. 14, 2017.
Extended European Search Report for European Patent Application No. 19164719.7 dated Apr. 24, 2019; 7 pages.

*Primary Examiner* — Frederick C Conley
(74) *Attorney, Agent, or Firm* — Barnes & Thornburg LLP

(57) ABSTRACT

A patient support apparatus includes a frame having a patient support deck. A footboard is removably coupled to the frame. A compression therapy module is located inside the footboard or is mounted to a foot section of the frame. A sleeve port is pneumatically coupled to the compression therapy module and is located on the foot section. The sleeve port is configured for attachment to at least one tube extending from a compression sleeve worn on a limb of a patient. Control circuitry is coupled to the frame and is operable to control functions of the patient support apparatus and to control the compression therapy module. A graphical display screen is coupled to the control circuitry and displays user inputs that are selected to control functions of the patient support apparatus and the compression therapy module.

29 Claims, 11 Drawing Sheets

(51) Int. Cl.

| | |
|---|---|
| ***A47C 21/04*** | (2006.01) |
| ***A61G 7/05*** | (2006.01) |
| ***A61H 1/00*** | (2006.01) |
| *A61G 7/057* | (2006.01) |

(52) U.S. Cl.
CPC ..... *A61G 7/0506* (2013.01); *A61H 1/008* (2013.01); *A61H 9/0078* (2013.01); *A61G 7/05* (2013.01); *A61G 7/05769* (2013.01); *A61G 2203/10* (2013.01); *A61G 2210/00* (2013.01); *A61G 2210/70* (2013.01); *A61G 2210/90* (2013.01); *A61H 2201/0207* (2013.01); *A61H 2201/0214* (2013.01); *A61H 2201/0242* (2013.01); *A61H 2201/164* (2013.01); *A61H 2201/165* (2013.01); *A61H 2201/501* (2013.01); *A61H 2201/5046* (2013.01); *A61H 2201/5048* (2013.01); *A61H 2201/5071* (2013.01); *A61H 2201/5097* (2013.01); *A61H 2209/00* (2013.01); *A61H 2230/50* (2013.01)

(58) Field of Classification Search
USPC ..... 5/600, 621–624, 658
See application file for complete search history.

(56) References Cited

U.S. PATENT DOCUMENTS

| | | | |
|---|---|---|---|
| 1,608,239 | A | 11/1926 | Rosett |
| 2,361,242 | A | 10/1944 | Rosett |
| 2,531,074 | A | 11/1950 | Miller |
| 2,533,504 | A | 12/1950 | Poor |
| 2,699,165 | A | 1/1955 | Ferrier |
| 2,781,041 | A | 2/1957 | Weinberg |
| 2,823,668 | A | 2/1958 | van Court et al. |
| 2,880,721 | A | 4/1959 | Corcoran |
| 2,896,612 | A | 7/1959 | Bates et al. |
| 2,943,859 | A | 7/1960 | Koski et al. |
| 3,094,116 | A | 6/1963 | Logan et al. |
| 3,094,118 | A | 6/1963 | De Besme et al. |
| 3,177,866 | A | 4/1965 | Wesslund |
| 3,186,405 | A | 6/1965 | Bailey et al. |
| 3,454,010 | A | 7/1969 | Lilligren et al. |
| 3,548,809 | A | 12/1970 | Conti |
| 3,811,431 | A | 5/1974 | Apstein |
| 3,831,766 | A | 8/1974 | Newman et al. |
| 3,865,102 | A | 2/1975 | Birtwell et al. |
| 3,866,604 | A | 2/1975 | Curless et al. |
| 3,868,952 | A | 3/1975 | Hatton |
| 3,880,149 | A | 4/1975 | Kawaguchi |
| 3,889,494 | A | 6/1975 | Patience et al. |
| 3,892,229 | A | 7/1975 | Taylor et al. |
| 3,896,794 | A | 7/1975 | McGrath |
| 3,901,225 | A | 8/1975 | Sconce |
| 3,982,531 | A | 9/1976 | Shaffer |
| 4,013,069 | A | 3/1977 | Hasty |
| 4,021,860 | A | 5/1977 | Swallow et al. |
| 4,027,667 | A | 6/1977 | Swallow et al. |
| 4,029,087 | A | 6/1977 | Dye et al. |
| 4,030,488 | A | 6/1977 | Hasty |
| 4,054,952 | A | 10/1977 | Swallow |
| 4,069,515 | A | 1/1978 | Swallow et al. |
| 4,089,068 | A | 5/1978 | Swallow |
| 4,091,804 | A | 5/1978 | Hasty |
| 4,125,278 | A | 11/1978 | Hargraves |
| 4,156,425 | A | 5/1979 | Arkanszd |
| 4,157,713 | A | 6/1979 | Clarey |
| 4,180,869 | A | 1/1980 | Pedergrass et al. |
| 4,183,015 | A | 1/1980 | Drew et al. |
| 4,198,961 | A | 4/1980 | Arkans |
| 4,202,325 | A | 5/1980 | Villari et al. |
| 4,207,875 | A | 6/1980 | Arkans |
| 4,207,876 | A | 6/1980 | Annis |
| 4,253,449 | A | 3/1981 | Arkans et al. |
| 4,280,485 | A | 7/1981 | Arkans |
| 4,311,135 | A | 1/1982 | Brueckner et al. |
| 4,320,746 | A | 3/1982 | Arkans et al. |
| 4,331,133 | A | 5/1982 | Arkans |
| 4,335,726 | A | 6/1982 | Kolstedt |
| 4,369,588 | A | 1/1983 | Berguer |
| 4,370,975 | A | 2/1983 | Wright |
| 4,372,297 | A | 2/1983 | Perlin |
| 4,374,518 | A | 2/1983 | Villanueva |
| 4,375,217 | A | 3/1983 | Arkans |
| 4,388,923 | A | 6/1983 | Heimreid |
| 4,396,010 | A | 8/1983 | Arkans |
| 4,402,312 | A | 9/1983 | Villari et al. |
| 4,418,690 | A | 12/1983 | Mummert |
| 4,424,596 | A | 1/1984 | Jackson |
| 4,453,538 | A | 6/1984 | Whitney |
| 4,481,937 | A | 11/1984 | Arkans |
| 4,492,234 | A | 1/1985 | Arkans |
| 4,502,301 | A | 3/1985 | Swallow et al. |
| 4,513,740 | A | 4/1985 | Westlake |
| 4,527,402 | A | 7/1985 | Swallow et al. |
| 4,573,453 | A | 3/1986 | Tissot |
| 4,577,626 | A | 3/1986 | Marukawa et al. |
| 4,597,384 | A | 7/1986 | Whitney |
| 4,614,179 | A | 9/1986 | Gardner et al. |
| 4,614,180 | A | 9/1986 | Gardner et al. |
| 4,624,244 | A | 11/1986 | Taheri |
| 4,628,911 | A | 12/1986 | Bornstein |
| 4,648,392 | A | 3/1987 | Cartier et al. |
| 4,657,003 | A | 4/1987 | Wirtz |
| 4,680,790 | A | 7/1987 | Packard et al. |
| 4,682,588 | A | 7/1987 | Curlee |
| 4,696,289 | A | 9/1987 | Gardner et al. |
| 4,702,232 | A | 10/1987 | Gardner et al. |
| 4,721,101 | A | 1/1988 | Gardner et al. |
| 4,722,332 | A | 2/1988 | Saggers |
| 4,730,610 | A | 3/1988 | Graebe |
| 4,744,391 | A | 5/1988 | Lardner |
| 4,745,917 | A | 5/1988 | Hasty et al. |
| 4,753,226 | A | 6/1988 | Zheng et al. |
| 4,768,241 | A | 9/1988 | Beney |
| 4,773,397 | A | 9/1988 | Wright et al. |
| 4,793,328 | A | 12/1988 | Kolstedt et al. |
| 4,804,208 | A | 2/1989 | Dye |
| 4,805,601 | A | 2/1989 | Eischen, Sr. |
| 4,809,684 | A | 3/1989 | Gardner et al. |
| 4,827,912 | A | 5/1989 | Carrington et al. |
| 4,832,010 | A | 5/1989 | Lerman |
| RE32,939 | E | 6/1989 | Gardner et al. |
| RE32,940 | E | 6/1989 | Gardner et al. |
| 4,841,956 | A | 6/1989 | Gardner et al. |
| 4,846,160 | A | 7/1989 | Gardner et al. |
| 4,858,596 | A | 8/1989 | Kolstedt et al. |
| 4,865,020 | A | 9/1989 | Bullard |
| RE33,090 | E | 10/1989 | Berguer |
| 4,922,893 | A | 5/1990 | Wright et al. |
| 4,928,674 | A | 5/1990 | Halperin et al. |
| 4,938,208 | A | 7/1990 | Dye |
| 4,941,458 | A | 7/1990 | Taheri |
| 4,945,905 | A | 8/1990 | Dye et al. |
| 4,947,834 | A | 8/1990 | Kartheus et al. |
| 4,966,396 | A | 10/1990 | Dye |
| 4,971,044 | A | 11/1990 | Dye |
| 4,989,589 | A | 2/1991 | Pekanmaki et al. |
| 5,000,164 | A | 3/1991 | Cooper |
| 5,005,567 | A | 4/1991 | Gilman et al. |
| 5,007,411 | A | 4/1991 | Dye |
| 5,014,681 | A | 5/1991 | Neeman et al. |
| 5,022,387 | A | 6/1991 | Hasty |
| 5,025,781 | A | 6/1991 | Ferrari |
| 5,027,797 | A | 7/1991 | Bullard |
| 5,031,604 | A | 7/1991 | Dye |
| 5,074,285 | A | 12/1991 | Wright |
| 5,080,089 | A | 1/1992 | Mason et al. |
| 5,109,832 | A | 5/1992 | Proctor et al. |
| 5,117,812 | A | 6/1992 | McWhorter |
| 5,125,400 | A | 6/1992 | Johnson, Jr. |
| 5,127,808 | A | 7/1992 | Nichols et al. |
| 5,133,199 | A | 7/1992 | Parikh et al. |

(56) References Cited

U.S. PATENT DOCUMENTS 5,135,473 A 8/1992 Epler et al.
5,139,479 A 8/1992 Peters
5,176,624 A 1/1993 Kuehnreich
5,179,941 A 1/1993 Siemssen et al.
5,186,163 A 2/1993 Dye
5,211,162 A 5/1993 Gillen, Jr. et al.
5,218,954 A 6/1993 van Bemmelen
5,226,898 A 7/1993 Gross
5,263,473 A 11/1993 McWhorter
5,288,286 A 2/1994 Davis
5,307,791 A 5/1994 Senoue et al.
RE34,661 E 7/1994 Grim
5,328,445 A 7/1994 Spahn et al.
5,342,285 A 8/1994 Dye
5,354,260 A 10/1994 Cook
5,368,034 A 11/1994 Isner
5,368,547 A 11/1994 Polando
5,383,894 A 1/1995 Dye
5,389,065 A 2/1995 Johnson, Jr.
5,396,896 A 3/1995 Tumey et al.
D357,736 S 4/1995 Dye
D358,216 S 5/1995 Dye
5,413,142 A 5/1995 Johnson et al.
5,435,009 A 7/1995 Schild et al.
5,437,610 A 8/1995 Cariapa et al.
5,441,533 A 8/1995 Johnson et al.
5,443,440 A 8/1995 Tumey et al.
5,449,379 A 9/1995 Hadtke
D363,988 S 11/1995 Dye
D364,459 S 11/1995 Dye
D364,460 S 11/1995 Dye
D364,680 S 11/1995 Dye
5,464,385 A 11/1995 Grim
5,466,250 A 11/1995 Johnson, Jr. et al.
5,478,119 A 12/1995 Dye
D367,115 S 2/1996 Barber et al.
5,490,820 A 2/1996 Schock et al.
5,496,262 A 3/1996 Johnson, Jr. et al.
D369,664 S 5/1996 Dye
D373,192 S 8/1996 Murphy et al.
5,542,136 A 8/1996 Tappel
5,558,627 A 9/1996 Singer et al.
D374,931 S 10/1996 Cesaroni et al.
5,562,091 A 10/1996 Foster et al.
D376,013 S 11/1996 Sandman et al.
5,571,075 A 11/1996 Bullard
5,575,762 A 11/1996 Peeler et al.
5,584,798 A 12/1996 Fox
5,588,954 A 12/1996 Ribando et al.
5,588,955 A 12/1996 Johnson, Jr. et al.
5,591,020 A 1/1997 Cone et al.
5,591,200 A 1/1997 Cone et al.
5,596,770 A 1/1997 Kunesh
5,611,096 A 3/1997 Bartlett et al.
5,613,941 A 3/1997 Prengler
5,616,965 A 4/1997 Wolf et al.
5,626,556 A 5/1997 Tobler et al.
5,630,238 A 5/1997 Weismiller et al.
5,634,889 A 6/1997 Gardner et al.
5,647,079 A 7/1997 Hakamiun et al.
5,669,872 A 9/1997 Fox
5,671,751 A 9/1997 Tumey et al.
5,674,262 A 10/1997 Tumey
5,676,639 A 10/1997 Schild
5,688,225 A 11/1997 Walker
5,711,760 A 1/1998 Ibrahim et al.
5,713,954 A 2/1998 Rosenberg et al.
5,715,548 A 2/1998 Weismiller et al.
5,725,485 A 3/1998 Ribando et al.
5,730,136 A 3/1998 Laufer et al.
5,747,460 A 5/1998 Bylund et al.
5,769,801 A 6/1998 Tumey et al.
5,771,511 A 6/1998 Kummer et al.
5,781,949 A 7/1998 Weismiller et al.
5,783,563 A 7/1998 Antonsson et al.
5,795,312 A 8/1998 Dye
5,800,528 A 9/1998 Lederman et al.
5,810,750 A 9/1998 Buser
5,826,761 A 10/1998 Basaj
5,833,711 A 11/1998 Schneider, Sr.
5,840,049 A 11/1998 Tumey et al.
5,843,007 A 12/1998 McEwen et al.
5,865,722 A 2/1999 Heng
5,868,690 A 2/1999 Eischen, Sr.
5,876,359 A 3/1999 Bock et al.
5,891,065 A 4/1999 Cariapa et al.
5,916,183 A 6/1999 Reid
5,931,797 A 8/1999 Tumey et al.
5,938,628 A 8/1999 Oguri et al.
5,951,502 A 9/1999 Peeler et al.
5,968,073 A 10/1999 Jacobs
5,989,204 A 11/1999 Lina
6,001,119 A 12/1999 Hampson et al.
6,010,470 A 1/2000 Albery et al.
6,021,800 A 2/2000 Schild et al.
6,022,327 A 2/2000 Chang
6,036,662 A 3/2000 Van Brunt et al.
6,047,424 A 4/2000 Osborne et al.
6,058,538 A 5/2000 Chapman et al.
6,080,120 A 6/2000 Sandman et al.
6,095,983 A 8/2000 Wawro
6,119,291 A 9/2000 Osborne et al.
6,129,688 A 10/2000 Arkans
6,141,792 A 10/2000 Acker et al.
D434,150 S 11/2000 Tumey et al.
6,148,461 A 11/2000 Cook et al.
6,149,674 A 11/2000 Borders
6,171,270 B1 1/2001 Gau
6,193,679 B1 2/2001 Quinn
D439,341 S 3/2001 Tumey et al.
6,231,532 B1 5/2001 Watson et al.
6,249,198 B1 6/2001 Clark et al.
6,279,183 B1 8/2001 Kummer et al.
6,290,662 B1 9/2001 Morris et al.
6,296,617 B1 10/2001 Peeler et al.
6,315,745 B1 11/2001 Kloecker
6,319,215 B1 11/2001 Manor et al.
6,322,530 B1 11/2001 Johnson, Jr. et al.
6,355,008 B1 3/2002 Nakao
6,358,219 B1 3/2002 Arkans
6,361,512 B1 3/2002 Mackay et al.
6,368,357 B1 4/2002 Schon et al.
6,387,065 B1 5/2002 Tumey
6,436,064 B1 8/2002 Kloecker
6,440,093 B1 8/2002 McEwen et al.
6,447,467 B1 9/2002 Barak
6,450,981 B1 9/2002 Shabty et al.
6,454,583 B2 9/2002 Lepine et al.
6,463,934 B1 10/2002 Johnson, Jr. et al.
6,467,111 B1 10/2002 Vrzalik et al.
6,468,237 B1 10/2002 Lina
6,478,757 B1 11/2002 Barak
6,488,643 B1 12/2002 Tumey et al.
6,494,852 B1 12/2002 Barak et al.
6,530,941 B1 3/2003 Muller et al.
6,539,566 B1 4/2003 Hayes
6,544,202 B2 4/2003 McEwen et al.
6,551,280 B1 4/2003 Knighton et al.
6,558,338 B1 5/2003 Wasserman
6,572,621 B1 6/2003 Zheng et al.
6,585,669 B2 7/2003 Manor et al.
6,589,194 B1 7/2003 Calderon et al.
6,589,267 B1 7/2003 Hui
6,592,534 B1 7/2003 Rutt et al.
6,604,252 B1 8/2003 Lee et al.
6,610,021 B1 8/2003 Bock
6,611,979 B2 9/2003 Welling et al.
6,634,045 B1 10/2003 Dudonis et al.
6,829,796 B2 * 12/2004 Salvatini ..... A61G 7/05776 5/706
6,859,967 B2 3/2005 Harrison et al.
6,877,178 B2 4/2005 Chapman et al.
6,893,409 B1 5/2005 Lina
7,048,702 B2 5/2006 Hui

(56) References Cited

U.S. PATENT DOCUMENTS

| | | | | |
|---|---|---|---|---|
| 7,092,376 | B2 | 8/2006 | Schuman | |
| 7,154,397 | B2 | 12/2006 | Zerhusen et al. | |
| 7,235,057 | B2 | 6/2007 | LeVert et al. | |
| 7,299,832 | B2 | 11/2007 | Smith | |
| 7,314,478 | B2 | 1/2008 | Hui | |
| 7,398,803 | B2 | 7/2008 | Newton | |
| 7,448,984 | B2 | 11/2008 | Chow | |
| 7,534,215 | B2 | 5/2009 | Chappuis | |
| 7,641,623 | B2 | 1/2010 | Biondo et al. | |
| 7,740,574 | B2 | 6/2010 | Pilla et al. | |
| 7,741,966 | B2 | 6/2010 | Bonnefin et al. | |
| 7,976,486 | B2 | 7/2011 | Raley et al. | |
| 7,981,066 | B2 | 7/2011 | Lewis | |
| 8,011,039 | B2 | 9/2011 | Stryker et al. | |
| 8,038,632 | B2 | 10/2011 | Flick et al. | |
| 8,043,238 | B1 | 10/2011 | Tamura et al. | |
| 8,052,630 | B2 | 11/2011 | Kloecker et al. | |
| 8,114,037 | B2 | 2/2012 | Lewis | |
| 8,133,039 | B2 | 3/2012 | Anderson et al. | |
| 8,162,869 | B2 | 4/2012 | Graham | |
| 8,246,028 | B2 | 8/2012 | Larkin et al. | |
| 8,296,887 | B2 | 10/2012 | Doehler et al. | |
| 8,372,182 | B2 | 2/2013 | Vrzalik et al. | |
| 8,414,272 | B2 | 4/2013 | Swisher et al. | |
| 8,579,792 | B2 | 11/2013 | Pickett et al. | |
| 8,696,606 | B2 | 4/2014 | Jacofsky et al. | |
| 8,707,483 | B2 | 4/2014 | Richards et al. | |
| 8,757,165 | B2 | 6/2014 | Squitieri | |
| 8,827,936 | B1 | 9/2014 | Adaie | |
| 8,845,562 | B2 | 9/2014 | Receveur et al. | |
| 8,914,924 | B2 | 12/2014 | Stryker et al. | |
| 8,914,928 | B2 | 12/2014 | Huyser et al. | |
| 9,015,885 | B2 | 4/2015 | Chapin | |
| 9,050,031 | B2 | 6/2015 | Collins, Jr. et al. | |
| 9,119,760 | B2 | 9/2015 | Purdy et al. | |
| 9,152,768 | B2 | 10/2015 | Ribble | |
| 9,254,231 | B2 | 2/2016 | Vrzalik et al. | |
| 9,271,864 | B2 | 3/2016 | Feinstein | |
| 9,427,365 | B2 | 8/2016 | Richards et al. | |
| 9,463,126 | B2 | 10/2016 | Zerhusen et al. | |
| 2001/0011393 | A1 | 8/2001 | Brooke et al. | |
| 2001/0018564 | A1 | 8/2001 | Manor et al. | |
| 2002/0042583 | A1 | 4/2002 | Barak et al. | |
| 2003/0061664 | A1 | 4/2003 | Salvatini et al. | |
| 2003/0139255 | A1 | 7/2003 | Lina | |
| 2003/0167070 | A1 | 9/2003 | McEwen et al. | |
| 2005/0251067 | A1 | 11/2005 | Terry | |
| 2006/0016012 | A1 | 1/2006 | Liu | |
| 2006/0058717 | A1 | 3/2006 | Hui et al. | |
| 2006/0258964 | A1* | 11/2006 | Biondo ..... | A61H 9/0078 601/152 |
| 2007/0010766 | A1 | 1/2007 | Gil et al. | |
| 2007/0050910 | A1 | 3/2007 | Blanchard et al. | |
| 2009/0260639 | A1 | 10/2009 | Hsu et al. | |
| 2010/0076356 | A1 | 3/2010 | Biondo et al. | |
| 2010/0268121 | A1 | 10/2010 | Kilborn | |
| 2011/0054366 | A1 | 3/2011 | Smith et al. | |
| 2011/0132377 | A1 | 6/2011 | Phillips | |
| 2011/0234411 | A1 | 9/2011 | Harrington et al. | |
| 2012/0036636 | A1* | 2/2012 | Stryker ..... | A61G 7/001 5/600 |
| 2012/0311781 | A1 | 12/2012 | Purdy et al. | |
| 2013/0018291 | A1 | 1/2013 | Kraal et al. | |
| 2013/0046216 | A1* | 2/2013 | O'Keefe ..... | A61B 5/6892 601/149 |
| 2013/0062922 | A1 | 3/2013 | Dickson | |
| 2013/0074268 | A1 | 3/2013 | Receveur et al. | |
| 2013/0189920 | A1 | 7/2013 | Vrzalik et al. | |
| 2013/0198950 | A1 | 8/2013 | Purdy et al. | |
| 2013/0231596 | A1 | 9/2013 | Hornbach et al. | |
| 2014/0031730 | A1 | 1/2014 | Hornbach et al. | |
| 2014/0228718 | A1 | 8/2014 | Diller et al. | |
| 2014/0259413 | A1 | 9/2014 | Johnson et al. | |
| 2014/0323816 | A1 | 10/2014 | Soderberg et al. | |
| 2014/0343468 | A1 | 11/2014 | Ezenwa | |
| 2014/0366277 | A1 | 12/2014 | Niederkrom et al. | |
| 2015/0094623 | A1 | 4/2015 | Howell et al. | |
| 2015/0135436 | A1 | 5/2015 | Stryker et al. | |
| 2016/0008206 | A1 | 1/2016 | Devanaboyina | |
| 2016/0120726 | A1 | 5/2016 | Moriarty et al. | |
| 2016/0136356 | A1* | 5/2016 | Ribble ..... | G06F 19/3418 604/111 |
| 2016/0140307 | A1 | 5/2016 | Brosnan et al. | |

FOREIGN PATENT DOCUMENTS

| | | | |
|---|---|---|---|
| EP | 0926971 | B1 | 9/2004 |
| EP | 2918255 | A1 | 9/2015 |
| EP | 2887916 | B1 | 7/2016 |
| JP | 8-38562 | | 2/1996 |
| WO | WO 93/12708 | | 7/1993 |
| WO | WO 98/05383 | | 2/1998 |
| WO | WO 99/11215 | | 3/1999 |
| WO | WO 2000/054848 | A1 | 9/2000 |
| WO | WO 2004091463 | A2 | 10/2004 |
| WO | WO 2005/014120 | | 2/2005 |
| WO | WO 2010/083030 | A1 | 7/2010 |
| WO | WO 2011/070567 | A1 | 6/2011 |
| WO | WO 2013/121245 | A1 | 8/2013 |
| WO | WO 2014/036472 | A1 | 3/2014 |
| WO | WO 2015/124897 | A2 | 8/2015 |
| WO | WO 2015/148223 | A1 | 10/2015 |
| WO | WO 2015/171078 | A1 | 11/2015 |
| WO | WO 2016/014897 | A1 | 1/2016 |
| WO | WO 2016/015038 | A1 | 1/2016 |
| WO | WO 2016/028822 | A1 | 2/2016 |

* cited by examiner

PATIENT SUPPORT APPARATUS HAVING AN INTEGRATED LIMB COMPRESSION DEVICE

The present application claims the benefit, under 35 U.S.C. § 119(e), of U.S. Provisional Application No. 62/296,735, which was filed Feb. 18, 2016 and which is hereby incorporated by reference herein in its entirety.

BACKGROUND

The present disclosure relates to patient support apparatuses such as patient beds and particularly, to patient support apparatuses that have therapy devices. More particularly, the present disclosure relates to patient support apparatuses that have integrated limb compression devices.

Patient support apparatuses, such as patient beds, are used in patient rooms to support sick patients and to support patients recovering from surgery, for example. It is desirable for some patients to wear limb compression sleeves, such as foot sleeves, calf sleeves, thigh sleeves, or a combination of these sleeves. The sleeves are inflated and deflated intermittently to promote blood flow within the patient's leg or legs thereby to prevent deep vein thrombosis, for example. Usually, a separate control box which houses the pneumatic components that operate to inflate and deflate the compression sleeve(s) worn by the patient is provided.

Oftentimes, the control box for the compression sleeve(s) is hung on the footboard of the patient bed. Thus, there is a risk that the control box can slip off of the footboard. Also, relatively long power cords are required to be routed from the control box at the foot end of the bed to a power outlet near the head end of the bed or elsewhere in the patient room. The foot ends of patient beds are typically oriented more toward the center of a room and not adjacent to any room wall. The power cord, therefore, may pose a tripping hazard for caregivers, patients, and visitors. The power cord also may be in the way of other carts or wheeled stands, such as those used to support IV pumps and bags, for example. When not in use, the control box must be stored separately within a healthcare facility.

Some patient beds are designed to have control boxes for compression sleeves mounted elsewhere on the bed or within recesses specifically designed to accommodate the control boxes. See, for example, U.S. Pat. No. 6,387,065 which discloses a pneumatic box mounted to a base of a bed frame and a control panel mounted to a footboard. See also U.S. Pat. No. 7,641,623 which shows, in different embodiments, cavities within a footboard, siderail, head section and mattress for receiving a removable compression module. When the patient is ambulatory, the compression module is detached from the bed and carried with the patient. These prior art systems do not, however, vary operation of the compression therapy based on the status or condition of other features of the beds in which they are integrated. Accordingly, there is room for improvement in the use of compression therapy devices on patient beds.

SUMMARY

An apparatus, system, or method may comprise one or more of the features recited in the appended claims and/or the following features which, alone or in any combination, may comprise patentable subject matter:

According to the present disclosure, a patient support apparatus may include a frame that may have a patient support deck, control circuitry that may be carried by the frame, a footboard that may be coupled to the frame and that may have a first interior region, and a compression module that may be located within an interior region of the footboard. The compression module may have a housing and a second interior region in the housing. The second interior region may be in pneumatic communication with the first interior region through at least one first opening in the housing. The patient support apparatus may further have a sleeve port that may be pneumatically coupled to the compression module. The sleeve port may be configured for attachment to at least one tube that may extend from a compression sleeve that may be worn on a limb of a patient. An electrical cable may provide wired communication between the compression module and the control circuitry. The electrical cable may extend through a second opening that may be formed in the footboard. During operation of the compression module to inflate the compression sleeve, air may move from ambient surroundings into the first interior region of the footboard through the second opening and air may move into the second interior region in the housing of the compression module through the at least one first opening.

In some embodiments, during operation of the compression module to deflate the compression sleeve, air may exit from the second interior region of the housing of the compression module into the first interior region of the footboard and air may exit from the first interior region of the footboard into the ambient surroundings through the second opening. The footboard may have a bottom wall and the second opening may be provided in the bottom wall. The sleeve port may be attached to the footboard. A hose may extend between the compression module and the sleeve port through the first interior region of the footboard.

In some embodiments, the electrical cable may extend through the at least one first opening of the housing of the compression module. The compression module may be permanently mounted to the footboard. the compression module may include a filter and a pump and air entering the second interior region through the at least one first opening may pass through the filter before reaching the pump.

In some embodiments, the compression module may carry a heater unit in the second interior region and the heater unit may be operable to introduce heated air into a flow of air to the sleeve port. Alternatively or additionally, the footboard may carry a heater unit in the first interior region and the heater unit may be operable to introduce heated air into a flow of air to the sleeve port. Further alternatively or additionally, the compression module may carry a cooler unit in the second interior region and the cooler unit may be operable to introduce cooled air into a flow of air to the sleeve port. Still further alternatively or additionally, the footboard may carry a cooler unit in the first interior region and the cooler unit may be operable to introduce cooled air into a flow of air to the sleeve port.

In some embodiments, software for interfacing with the compression module may be stored in memory of the control circuitry prior to installation of the compression module in the footboard. Alternatively or additionally, software for interfacing with the compression module may be stored in memory of the compression module and the compression module may transmit the software to the control circuitry after installation of the compression module of the footboard. Further alternatively or additionally, the control circuitry may download software for interfacing with the compression module from a remote computer after determining a type of the compression module installed in the footboard.

Further according to the present disclosure, a patient support apparatus may be provided for use with a plurality of compression modules of different types. The patient support apparatus may include a frame that may have a patient support deck, control circuitry that may be carried by the frame, and a footboard that may be coupled to the frame and that may have a first interior region. The first interior region may include a space in which each one of the plurality of compression modules may be installable. The space may be sized such that only one installed compression module of the plurality of compression modules may be able to fit in the space at any given time. A sleeve port may be pneumatically coupled to the installed compression module. The sleeve port may be configured for attachment to at least one tube that may extend from a compression sleeve that may be worn on a limb of a patient. The control circuitry may determine which type of compression module may correspond to the installed compression module and may use module software associated with the installed compression module and may not use other software associated with each of the other compressions modules of the plurality of compression modules that may not be installed in the footboard.

In some embodiments, software for each type of compression module of the plurality of compression modules may be stored in memory of the control circuitry prior to installation of any of the compression modules of the plurality of compression modules in the footboard. The control circuitry may use the software associated with the installed compression module after determining which type of compression module corresponds to the installed compression module. Alternatively or additionally, software for each type of compression module of the plurality of compression modules may be stored in memory of the respective compression module and the installed compression module may transmit the software to the control circuitry after installation. Further alternatively or additionally, the control circuitry may downloads the software for the installed compression module from a remote computer after determining the type of compression module that may be installed in the footboard.

In some embodiments, at least one compression module of the plurality of compression modules may carry a heater unit that may be operable to introduce heated air into a flow of air to the sleeve port. Alternatively or additionally, the footboard may carry a heater unit that may be operable to introduce heated air into a flow of air to the sleeve port. In some embodiments, at least one compression module of the plurality of compression modules may carry a cooler unit that may be operable to introduce cooled air into a flow of air to the sleeve port. Alternatively or additionally, the footboard may carry a cooler unit that may be operable to introduce cooled air into a flow of air to the sleeve port.

In some contemplated embodiments, the compression module may receive power wirelessly from the patient support apparatus. For example, the compression module may include a first coil, the control circuitry may be coupled to a second coil, and the first and second coils may be inductively coupled to provide the power wirelessly to the compression module. Alternatively or additionally, the compression module may communicate wirelessly with the control circuitry of the patient support apparatus. In such embodiments, the compression module may include a first transceiver, the control circuitry may be coupled to a second transceiver, and the first and second transceivers may be communicatively coupled to provide wireless communication between the compression module and the control circuitry. In some embodiments, the compression module receives data and power wirelessly from the patient support apparatus. For example, the module may include a first coil, the control circuitry may be coupled to a second coil, and the first and second coils may be inductively coupled to provide the data and power wirelessly to the compression module.

According to a further aspect of the present disclosure, a patient support apparatus may include a frame that may have a patient support deck, control circuitry that may be carried by the frame, a footboard that may be coupled to the frame and that may have an interior region, a compression module that may be located within the interior region of the footboard and that may be operable to inflate a deflate a compression sleeve worn on a limb of a patient. The compression module may have module circuitry. A sleeve port may be pneumatically coupled to the compression module. The sleeve port may be configured for attachment to at least one tube that may extend from the compression sleeve. The module circuitry may be powered wirelessly.

In some embodiments, the compression module may receive power wirelessly from the patient support apparatus. For example, the compression module may include a first coil that may be coupled to the module circuitry. The control circuitry may be coupled to a second coil. The first and second coils may be inductively coupled to provide the power wirelessly to the compression module. Optionally, the module circuitry may include a battery that may be charged by the power received wirelessly by the first coil from the second coil.

In some embodiments, the compression module may include a housing that may have a second interior region and the first coil may be situated within the second interior region. Alternatively, the footboard may carry a first coil that may be coupled to the module circuitry. The control circuitry may be coupled to a second coil and the first and second coils may be inductively coupled to provide the power wirelessly to the compression module. In such embodiments, the module circuitry may include a battery that may be charged by the power received wirelessly by the first coil from the second coil. If desired, the first coil may be situated within the interior region of the footboard.

In some embodiments, the module circuitry may communicate wirelessly with the control circuitry of the patient support apparatus. For example, the compression module may include a first transceiver that may be coupled to the module circuitry, the control circuitry may be coupled to a second transceiver, and the first and second transceivers may be communicatively coupled to provide wireless communication between the module circuitry and the control circuitry. In some embodiments, wireless communication and wireless power is provided to the module circuitry over a common wireless link. For example, the common wireless link may include inductively coupled first and second coils.

According to another aspect of the present disclosure, a patient support apparatus may include a frame that may have a patient support deck, control circuitry that may be carried by the frame, a footboard that may be coupled to the frame and that may have an interior region, a compression module that may be located within the interior region of the footboard and that may be operable to inflate and deflate a compression sleeve worn on a limb of a patient. The compression module may have module circuitry. A sleeve port may be pneumatically coupled to the compression module. The sleeve port may be configured for attachment to at least one tube that may extend from the compression sleeve. A heater or cooler may be configured to introduce temperature controlled air into an air stream that may be provided from the compression module to the sleeve port.

In some embodiments, the heater or cooler may be controlled by the module circuitry. Alternatively or additionally, the heater or cooler may be controlled by the control circuitry. The heater or cooler may be carried by the compression module or may be carried by the footboard. For example, the compression module may include a housing that may have a second interior region and the heater or cooler may be situated in the second interior region. Alternatively, the heater or cooler unit may be situated in the interior region of the footboard.

In some embodiments, the sleeve port may include first and second sleeve ports. The heater or cooler may include first and second heaters or first and second coolers. The first sleeve port may be coupled to the first heater or the first cooler and the second sleeve port may be coupled to the second heater or the second cooler. The first and second heaters or first and second coolers both may be situated inside the compression module or in the interior region of the footboard outside the compression module.

According to still another aspect of the present disclosure, a patient support apparatus may include a frame that may include a patient support deck. The patient support deck may have a plurality of deck sections including a foot section. A footboard may be removably coupled to the frame. A compression therapy module may be located inside the footboard or may be mounted to the foot section. A sleeve port may be pneumatically coupled to the compression therapy module and may be located on the foot section. The sleeve port may be configured for attachment to at least one tube extending from a compression sleeve that may be worn on a limb of a patient. The patient support apparatus may further have control circuitry that may be coupled to the frame and that may be operable to control functions of the patient support apparatus including movement of at least one of the deck sections of the plurality of deck sections and to control the compression therapy module. A graphical display screen may be coupled to the control circuitry and may display user inputs that are selected to control functions of the patient support apparatus and the compression therapy module.

In some embodiments, the foot section may include a first portion and a second portion that may extend and retracts relative to the first portion. The compression therapy module may be mounted to the second portion. The compression therapy module may be mounted to an undersurface of the second portion, for example. If desired, the sleeve port may be mounted to a side surface of the second portion. The sleeve port may include a first sleeve port that may be mounted to a first side surface of the second portion and a second sleeve port that may be mounted to a second side surface of the second portion. The first and second side surfaces of the second portion may be situated on opposite sides of the foot section.

In some embodiments, the compression therapy module may be located inside the footboard and the patient support apparatus may further include a first electrical connector and a first pneumatic connector that may be on the bottom of the footboard. A second electrical connector and a second pneumatic connector may be on the frame. The first electrical connector and the first pneumatic connector may mate automatically with the second electrical connector and the second pneumatic connector, respectively, when the footboard is coupled to the frame. The footboard may be removably coupleable to the foot section of the frame. The foot section may include a first portion and a second portion that may extend and retract relative to the first portion and the footboard may be removably coupleable to the second portion, for example.

In those embodiments in which the compression therapy module may be located inside the footboard, the patient support apparatus may further include a lock that may have a locked mode and a released mode. The control circuitry may command the lock to operate in the locked mode when the compression therapy module may be operating to inflate and deflate a compression sleeve that may be coupled to the sleeve port so that the footboard may be prevented from being removed from the frame during operation of the compression therapy module. The control circuitry may command the lock to operate in the released mode when the compression therapy module ceases operation so that the footboard may be able to be removed from the frame. The foot section may include a first portion and a second portion that may extend and retract relative to the first portion. The footboard may be removably coupleable to the second portion and the lock may be attached to the second portion.

In some embodiments, the plurality of deck sections may include a head section to support a patient's upper body and the patient support apparatus may further comprise an angle sensor to sense an angle at which the head section may be elevated relative to horizontal or relative to another portion of the frame. The control circuitry may vary an operating parameter of compression therapy of the compression therapy module depending upon the angle of the head section sensed by the angle sensor. Alternatively or additionally, the patient support apparatus may further include a scale system that may be carried by the frame and that may be operable to determine a weight of the patient. The control circuitry may vary an operating parameter of compression therapy of the compression therapy module depending upon the weight of the patient sensed by the scale system.

In some embodiments, the patient support apparatus may include a patient position monitoring system that may be carried by the frame and that may be operable to determine a position of the patient. The control circuitry may signal the compression therapy module to cease operating if the patient is sensed by the patient position monitoring system to have violated a boundary condition. Alternatively or additionally, the control circuitry may be configured to receive information that may be communicated from a remote computer over a network of a healthcare facility and the control circuitry may vary an operating parameter of compression therapy of the compression therapy module depending upon the information received from the remote computer.

In some embodiments, the control circuity may be configured to send information regarding usage of the compression therapy module to a remote computer over a network of a healthcare facility. Alternatively or additionally, the control circuitry may be configured to send information regarding usage of the compression therapy module to an in-room display spaced from the patient support apparatus. The in-room display may comprise a graphical station of a nurse call system, for example. Optionally, the control circuitry may be configured to lock out at least one bed function in response to the compression therapy module being in use. For example, the at least one bed function that may be locked out may include movement of at least one deck section of the plurality of deck sections.

In some embodiments, the patient support apparatus further includes a control panel that may have manual buttons. The control panel may be spaced from the graphical display screen. The buttons may be used to move at least one deck section of the plurality of deck sections. The patient support apparatus may further include an air mattress that may be supported on the patient support deck and the user inputs that may be selected to control functions of the patient support apparatus may include user inputs that may be selected to control functions of the air mattress.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying drawings, in which.

DETAILED DESCRIPTION

Figure 1:
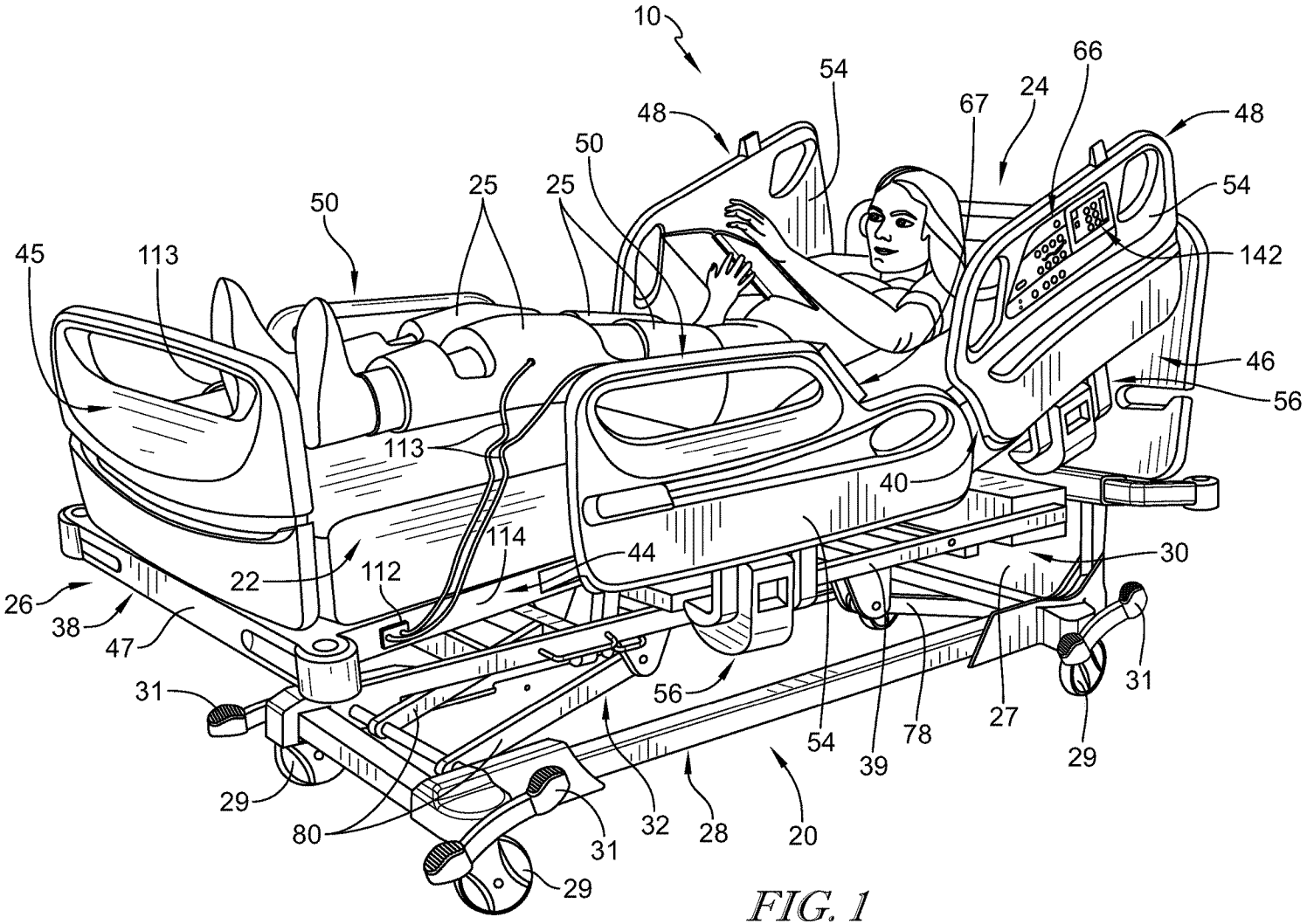
FIG. 1 is a perspective view of a patient bed showing a patient lying on the bed with compression sleeves on the patient legs and showing a foot section of the bed having ports for connection of tubes that extend from the ports to the compression sleeves.

A patient support apparatus, such as illustrative hospital bed 10, includes a patient support structure such as a frame 20 that supports a surface or mattress 22 as shown in FIG. 1. While apparatus 10 is embodied as a hospital bed 10, this disclosure is applicable to other types of patient support apparatuses, including other types of beds, surgical tables, examination tables, stretchers, and the like. As will be described below in further detail, a graphical user interface (GUI) 142 of bed 10 is operable to control operation of a limb compression device and to control features or functions of bed 10. GUI 142 is also referred to herein as a graphical display screen 142.

Figure 7:
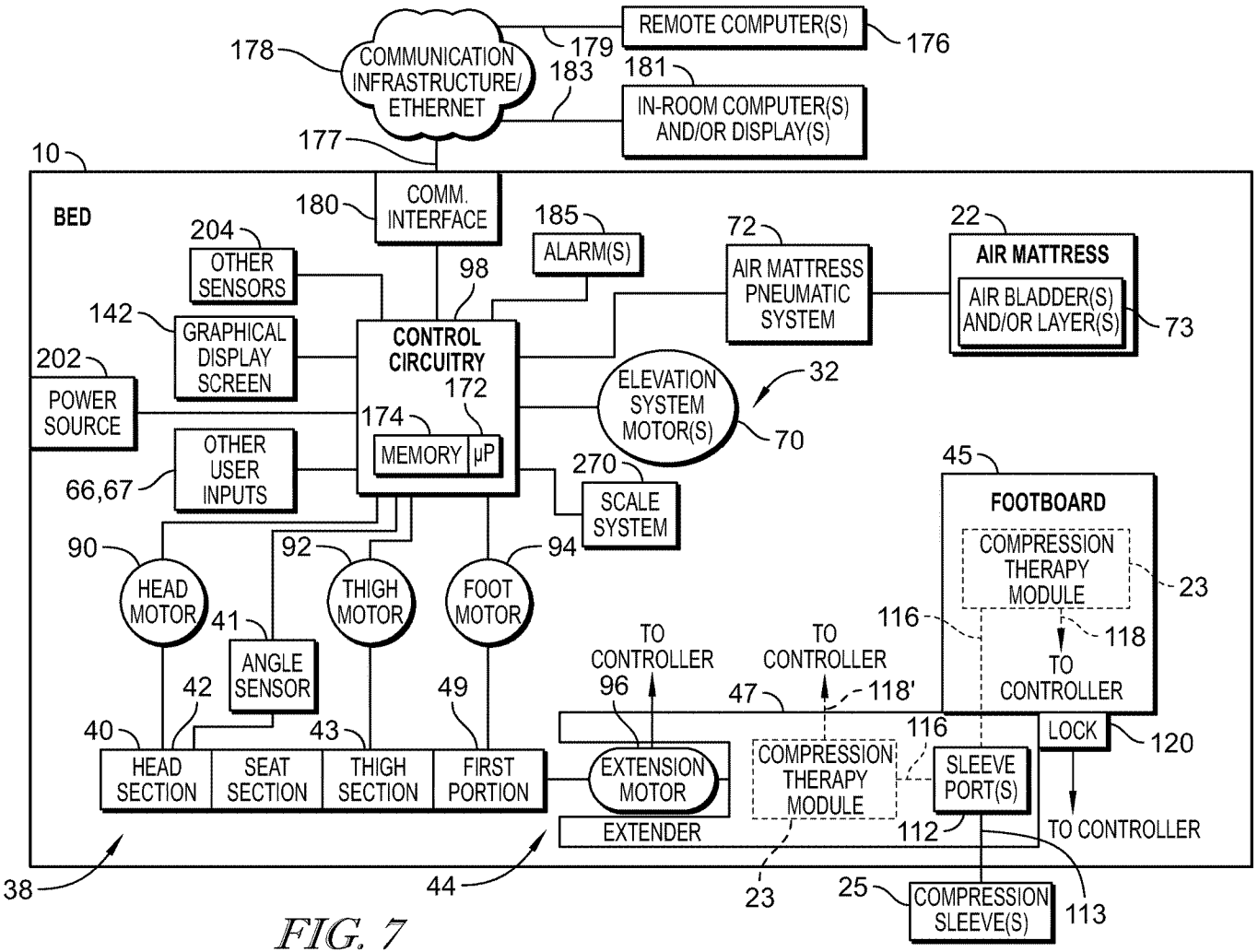
FIG. 7 is a block diagram showing electrical and pneumatic components of the patient bed of FIG. 1 and showing a pair of compression therapy modules (in phantom) with one of the compression therapy modules being housed inside the footboard according to one embodiment of the patient bed and the other of the compression therapy modules being located on an extender portion of a foot section according to a second embodiment of the patient bed.

The limb compression device disclosed herein includes a compression therapy module 23, shown diagrammatically in FIG. 7, which is integrated into bed 10 and one or more compression sleeves 25 that are placed upon a patient's limbs as shown, for example, in FIG. 1. Sleeves 25 are configured as wraps in some embodiments that are sized to wrap about a patient's calves, thighs, and/or feet. Combination sleeves that attach to a patient's calves and feet or that attach to a patient's calves and thighs or that attach to a patient's feet, calves and thighs are within the scope of this disclosure. Sleeves that attach to a patient's arms or torso are also within the scope of this disclosure. However, sleeves that attach to a patient's legs are the ones that are most commonly used in the healthcare environment, particularly, for the prevention of deep vein thrombosis (DVT).

The compression therapy devices disclosed herein are sometimes referred to as sequential compression devices (SCD's) or intermittent compression devices (ICD's) or deep vein thrombosis (DVT) prevention systems or the like. Thus, these terms and variants thereof are used interchangeably herein to cover all types of devices and systems that have compression sleeves with one or more inflatable and deflatable chambers that are controlled pneumatically by delivery and removal of air or other gas from a set of pneumatic components that are usually, but not necessarily, contained within a housing.

Referring again to FIG. 1, frame 20 of bed 10 includes a lower frame or base 28, an upper frame assembly 30 and a lift system 32 coupling upper frame assembly 30 to base 28. Lift system 32 is operable to raise, lower, and tilt upper frame assembly 30 relative to base 28. Bed 10 has a head end 24 and a foot end 26. Bed 10 further includes a footboard 45 at the foot end 26 and a headboard 46 at the head end 24. Headboard 46 is coupled to an upstanding portion 27 of base 28. Footboard 45 is coupled to an extendable and retractable portion 47 of a foot section 44 of a patient support deck 38 of upper frame assembly 30 as will be described in more detail below. In other embodiments, footboard 45 is coupled to a foot end of upper frame assembly 30. Base 28 includes wheels or casters 29 that roll along a floor as bed 10 is moved from one location to another. A set of foot pedals 31 are coupled to base 28 and are used to brake and release casters 29 as is known in the art.

Illustrative hospital bed 10 has four siderail assemblies coupled to upper frame assembly 30 as shown in FIG. 1. The four siderail assemblies include a pair of head siderail assemblies 48 (sometimes referred to as head rails) and a pair of foot siderail assemblies 50 (sometimes referred to as foot rails). Each of the siderail assemblies 48, 50 is movable between a raised position, as shown in FIG. 1, and a lowered position (not shown but well-known to those skilled in the art). Siderail assemblies 48, 50 are sometimes referred to herein as siderails 48, 50. Each siderail 48, 50 includes a barrier panel 54 and a linkage 56. Each linkage 56 is coupled to the upper frame assembly 30 and is configured to guide the barrier panel 54 during movement of siderails 48, 50 between the respective raised and lowered positions.

In the illustrative embodiment, barrier panel 54 is maintained by the linkage 56 in a substantially vertical orientation during movement of siderails 48, 50 between the respective raised and lowered positions. However, siderails that do not remain in a vertical orientation during raising and lowering are within the scope of this disclosure as are siderails that completely detach from the associated bed. Beds without any siderails are also within the scope of the present disclosure, in which case user inputs shown on siderails 48 of bed 10 and described below are provided on some other portion of bed 10, such as footboard 45 or headboard 46, or on a handheld controller 67.

Upper frame assembly 30 includes a patient support deck 38 that supports mattress 22. Patient support deck 38 is situated over an upper frame 39 of frame assembly 30. Patient support deck 38 includes a head section 40, a seat section 42, a thigh section 43 and a foot section 44 in the illustrative example as shown in FIG. 1 and as shown diagrammatically in FIG. 7. Sections 40, 43, 44 are each movable relative to upper frame 39. For example, head section 40 pivotably raises and lowers relative to seat section 42 whereas foot section 44 pivotably raises and lowers relative to thigh section 43. Additionally, thigh section 43 articulates relative to seat section 42. Also, in some embodiments such as the illustrative embodiment, foot section 44 is extendable and retractable to change the overall length of foot section 44 and therefore, to change the overall length of deck 38. For example, foot section 44 includes a first portion 49 and a second portion or extender 47 in some embodiments as shown diagrammatically in FIG. 7.

In the illustrative embodiment, seat section 42 is fixed in position with respect to upper frame 36 as patient support deck 38 moves between its various patient supporting positions including a horizontal position, shown diagrammatically in FIG. 7, to support the patient in a supine position, for example, and a chair position (not shown) to support the patient in a sitting up position. In other embodiments, seat section 42 also moves relative to weigh frame 36, such as by pivoting and/or translating. If desired, in those embodiments in which seat section 42 translates along upper frame 42, the thigh and foot sections 43, 44 also translate along with seat section 42. As bed 10 moves from the bed position to the chair position, foot section 44 lowers relative to thigh section 43 and, in some embodiments, shortens in length due to retraction of the extender 47 relative to first portion 49. As bed 10 moves from the chair position to the bed position, foot section 44 raises relative to thigh section 43 and increases in length due to extension of extender 47 relative to first portion 49. Thus, in the chair position, head section 40 extends upwardly from upper frame 36 and foot section extends downwardly from thigh section 43. The thigh section 43 may tilt upwardly relatively to seat section 42 as bed 10 moves into the chair position in some embodiments.

As shown diagrammatically in FIG. 7, bed 10 includes a head motor or actuator 90 coupled to head section 40, a knee motor or actuator 92 coupled to thigh section 43, a foot motor or actuator 94 coupled to foot section 44, and a foot extension motor or actuator 96 coupled to first portion 49 and extender 47 of foot section 44. Motors 90, 92, 94, 96 may include, for example, an electric motor of a linear actuator. In some embodiments in which seat section 42 translates along upper frame 30 as mentioned above, a seat motor or actuator (not shown) is also provided. Head motor 90 is operable to raise and lower head section 40, knee motor 92 is operable to articulate thigh section 43 relative to seat section 42, foot motor 94 is operable to raise and lower foot section 44 relative to thigh section 43, and foot extension motor 96 is operable to extend and retract extender 47 of foot section 44 relative to first portion 44 of foot section 44.

Bed 10 includes an angle sensor 41 coupled to head section 40 and electrically coupled to circuitry 98 as shown in FIG. 7. Angle sensor 41 comprises an accelerometer, inclinometer, or the like in some embodiments. In other embodiments, angle sensor 41 comprises a potentiometer, such as a potentiometer included in head motor 90 or a potentiometer having a housing fixed with respect to upper frame 39, for example, and having a rotatable input shaft coupled to head section 40 to rotate as the head section 40 raises and lowers. In any event, regardless of the type of angle sensor 41 used, its output is provided to control circuitry 98 and correlates to an angle of head section 40 relative to gravity or horizontal or relative to upper frame 39, as the case may be. Similar angle sensors are provided with regard to thigh section 43 and foot section 44, or the respective motors 82, 94, in some embodiments as well as in connection with motors 70 or upper frame 39 in some embodiments. Thus, circuitry 98 receives feedback from one or more angle sensors regarding the angular orientation of each of the movable portions, such as upper frame 39 and sections 40, 43, 44 of frame 20.

In some contemplated embodiments, mattress 22 is an air mattress that contains one or more air bladders or layers 73 as shown diagrammatically in FIG. 7. In such embodiments, bed 10 includes a pneumatic system 72 that controls inflation and deflation of the various air bladders or cells and/or layers of air mattress 22. The pneumatic system 72 is represented in FIG. 7 as a single block but that block 72 is intended to represent one or more air sources (e.g., a fan, a blower, a compressor) and associated valves, manifolds, air passages, air lines or tubes, pressure sensors, and the like, as well as the associated electric circuitry, that are typically included in a pneumatic system for inflating and deflating air bladders of mattresses of patient beds.

As also shown diagrammatically in FIG. 7, lift system 32 of bed 10 includes one or more elevation system motors or actuators 70, which in some embodiments, comprise linear actuators with electric motors. Thus, actuators 70 are sometimes referred to herein as motors 70. Alternative actuators or motors contemplated by this disclosure include hydraulic cylinders and pneumatic cylinders, for example. The motors 70 of lift system 32 are operable to raise, lower, and tilt upper frame assembly 30 relative to base 28. In the illustrative embodiment, one of motors 70 is coupled to, and acts upon, a set of head end lift arms 78 and another of motors 70 is coupled to, and acts upon, a set of foot end lift arms 80 to accomplish the raising, lowering and tilting functions of upper frame assembly 30 relative to base 28. Guide links (not shown) are coupled to base 28 and to lift arms 80 in some embodiments. Thus, lift system 32 of bed 10 is substantially similar to the lift system of the VERSACARE® bed available from Hill-Rom Company, Inc. Other aspects of bed 10 are also substantially similar to the VERSACARE® bed in some embodiments and are described in more detail in U.S. Pat. Nos. 6,658,680; 6,611,979; 6,691,346; 6,957,461; and 7,296,312, each of which is hereby expressly incorporated by reference herein to the extent not inconsistent with the present disclosure which shall control as to any inconsistencies.

Each siderail 48 includes a first user control panel 66 coupled to the outward side of the associated barrier panel 54 and each siderail 50 includes mounting features for a second user control panel 67, which is provided on a handheld control unit which is sometimes referred to in the art as a pendant. Control panel 66 is adjacent to, but spaced from GUI 142. Controls panels 66, 67 include various buttons that are used by a caregiver (not shown) or a patient in the case of control panel 67, to control associated functions of bed 10. For example, control panels 66, 67 include buttons that are used to operate head motor 90 to raise and lower the head section 40, buttons that are used to operate knee motor 92 to raise and lower the thigh section, and buttons that are used to operate motors 70 to raise, lower, and tilt upper frame assembly 30 relative to base 28. In the illustrative embodiment, control panels 66, 67 include buttons that are used to operate motor 94 to raise and lower foot section 44 and buttons that are used to operate motor 96 to extend and retract foot extension 47 relative to main portion 49. In other embodiments, some buttons included on control panel 66 are omitted from control panel 67. For example, buttons to operate motors 70, 96 are omitted from control panel 67 in some embodiments. In some embodiments, the buttons of control panels 66, 67 comprise membrane switches.

As shown diagrammatically in FIG. 7, bed 10 includes control circuitry 98 that is electrically coupled to motors 90, 92, 94, 96 and to motors 70 of lift system 32. Control circuitry 98 is represented diagrammatically as a single block 98 in FIG. 7, but control circuitry 98 in some embodiments comprises various circuit boards, electronics modules, and the like that are electrically and communicatively interconnected. Control circuitry 98 includes one or more microprocessors 172 or microcontrollers that execute software to perform the various bed control functions and algorithms along with compression device control functions and algorithms as described herein. Thus, circuitry 98 also includes memory 174 for storing software, variables, calculated values, and the like as is well known in the art.

As also shown diagrammatically in FIG. 7, a user inputs block represents the various user inputs such as buttons of control panels 66, 67, for example, that are used by the caregiver or patient to communicate input signals to control circuitry 98 of bed 10 to command the operation of the various motors 70, 90, 92, 94, 96 of bed 10, as well as commanding the operation of other functions of bed 10. Bed 10 includes at least one graphical user input (GUI) or display screen 142 coupled to a respective siderail 48 as shown in FIG. 1. Display screen 142 is coupled to control circuitry 98 as shown diagrammatically in FIG. 7. In some embodiments, two GUI's 142 are provided and are coupled to respective siderails 48. Alternatively or additionally, one or more GUI's are coupled to siderails 50 and/or to one or both of the headboard 46 and footboard 45. Thus, it is contemplated by this disclosure that a GUI 142 may be coupled to any of barriers 45, 46, 48, 50 of bed 10. Alternatively or additionally, GUI 142 is provided on a hand-held device such as a tablet, phone, pod or pendant that communicates via a wired or wireless connection with control circuitry 98.

Control circuitry 98 receives user input commands, sometimes referred to herein as simply "user inputs," from GUI 142 when display screen 142 is activated. The user input commands control various functions of compression therapy module 23 and various functions of bed 10 such as controlling the pneumatic system 72 and therefore, the surface functions of surface 22. In other embodiments, surface 22 is not controlled by GUI 142. In some embodiments, the input commands entered on GUI 142 also control the functions of one or more of motors 70, 90, 92, 94, 96 but this need not be the case. In some embodiments, input commands entered on the user interface 142 also control functions of a scale system 270, which is discussed in more detail below. Various examples of the various alternative or additional functions of bed 10 that are controlled by GUI 142 in various embodiments can be found in U.S. Patent Application Publication Nos. 2012/0089419 A1, 2008/0235872 A1 and 2008/0172789 A1, each of which is hereby incorporated by reference herein to the extent not inconsistent with the present disclosure which shall control as to any inconsistencies.

In some embodiments, control circuitry 98 of bed 10 communicates with a remote computer device 176 via communication infrastructure 178 such as an Ethernet of a healthcare facility in which bed 10 is located and via communications links 177, 179 as shown diagrammatically in FIG. 7. Infrastructure 178 may be operated according to, for example, the IEEE 802.3 (wired Ethernet) standard and/or the IEEE 802.11 (wireless Ethernet or WiFi) standard. Computer device 176 is sometimes simply referred to as a "computer" or a "server" herein. In some embodiments, control circuitry 98 of bed 10 communicates with one or more in-room computers or displays 181 via communication infrastructure 178 and via communications link 183. In some embodiments, display 181 is a room station of a nurse call system.

Figure 2:
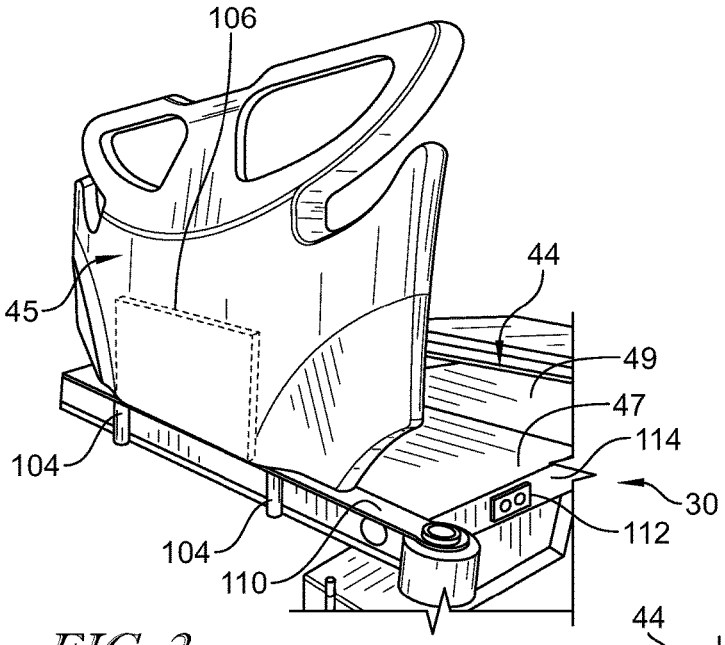
FIG. 2 is a perspective view of a footboard of the patient bed of FIG. 1 showing an outline of a space within the footboard for receiving a compression module that houses pneumatic and electrical components which operate to inflate and deflate the compression sleeves.

Remote computer 176 may be part of a bed data system, for example. One example of a bed data system is shown and described in U.S. Patent Application Publication No. 2012/0316892 A1 which is hereby incorporated herein by reference to the extent that it is not inconsistent with the present disclosure which shall control as to any inconsistencies. Alternatively or additionally, it is within the scope of this disclosure for circuitry 98 of bed 10 to communicate with other computers 176 or servers 176 such as those included as part of an electronic medical records (EMR) system, a nurse call system, a physician ordering system, an admission/discharge/transfer (ADT) system, or some other system used in a healthcare facility in other embodiments, although this need not be the case. Ethernet 178 in FIG. 2 is illustrated diagrammatically and is intended to represent all of the hardware and software that comprises a network of a healthcare facility.

In the illustrative embodiment, bed 10 has a communication interface or port 180 which provides bidirectional communication via link 177 with infrastructure 178 which, in turn, communicates bidirectionally with computers 176, 181 via links 179, 183 respectively. Link 177 is a wired communication link in some embodiments and is a wireless communications link in other embodiments. Thus, communications link 177, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which is hereby expressly incorporated by reference herein to the extent not inconsistent with the present disclosure which shall control as to any inconsistencies. In other embodiments, communications link 179 comprises wireless signals sent between bed 10 and a wireless interface unit or a wireless access point of the type shown and described in U.S. Patent Application Publication No. 2007/0210917 A1 which is hereby expressly incorporated by reference herein to the extent that it is not inconsistent with the present disclosure which shall control as to any inconsistencies. Furthermore, communications links 179, 183 each comprises one or more wired links and/or wireless links as well, according to this disclosure.

Still referring to FIG. 7, circuitry 98 is coupled to scale system 270 as mentioned above. Scale system 270 includes one or more sensors (not shown) that are used to detect weight of the patient and/or the movement of the patient on bed 10 and/or the exit of the patient from bed 10. In one embodiment, the sensors of scale system 270 are load cells that are included as part of bed frame 20. The load cells each include strain gage elements that are mounted to a mass of material, such as a metal material like aluminum, and that change resistance based on an amount that the mass of material of the load cell is deflected. A discussion of how the use of load cells as sensors of scale system 270 may provide different bed exit modes of varying levels of sensitivity can be found in U.S. Pat. No. 7,253,366 which is hereby incorporated by reference herein to the extent not inconsistent with the present disclosure which shall control as to any inconsistencies. Signals from the load cells are also used by the scale system 270 of bed 10 to calculate patient weight.

The sensors of system 270 can include other types of sensing devices in other embodiments. For example, suitable sensors may include force sensitive resistors (FSRs) that are placed beneath the mattress 22 of the bed 10 on the patient support deck 38. In fact, one example in which FSRs are used in combination with load cells in a bed exit alarm system is described in U.S. Pat. No. 7,296,312 which is already incorporated by reference herein. Other examples in which FSRs are used as part of a bed exit alarm system are shown and described in U.S. Pat. Nos. 7,464,605 and 6,208,250 which are both hereby incorporated by reference herein to the extent not inconsistent with the present disclosure which shall control as to any inconsistencies. Other types of contemplated sensors include capacitive sensors such as those shown and described in U.S. Pat. No. 5,808,552 and tape switches such as those shown and described in U.S. Pat. No. 4,539,560, both of which are hereby incorporated by reference herein to the extent not inconsistent with the present disclosure which shall control as to any inconsistencies. Thus, according to this disclosure the sensors of scale system 270, which serves also as a bed exit and/or patient position monitoring system of bed 10, can be of one type, such as load cells, FSRs, tape switches, or capacitive sensors, just to name a few, or can be of different types, such as using combinations of the sensors mentioned herein.

As shown in FIG. 7, bed 10 has one or more alarms 185 such one or more audible alarms and/or one or more visual alarms that are coupled to circuitry 98. Audible alarms 185 include, for example, a speaker, piezoelectric buzzer, or the like. Circuitry 98 commands audible alarms 185 to sound in response to various alarm conditions being detected. Visual alarms 185 include, for example, one or more alert lights that are provided one frame 20 of bed 10 and that are activated in different ways to indicate the conditions of bed 10. When no alerts or alarms exist, the lights are activated to shine green, for example. When an alert or alarm occurs, including a bed exit alarm, lights 88 are activated to shine red or amber and, in some embodiments, to blink. Additional details of suitable visual alarms for use in bed 10 are found in U.S. Pat. No. 8,593,284 and in U.S. Patent Application Publication No. 2014/0259410 A1, each of which is hereby incorporated by reference herein to the extent not inconsistent with the present disclosure which shall control as to any inconsistences. Other visuals alarms that may be used in addition to, or instead of such alert lights, include changing a background color of graphical display screen 142 and/or displaying an iconic or textual alarm message on display screen 142 and may even include IV pole mounted or wall mounted devices such as lights or graphical display screens.

It should be understood that FIG. 7 is diagrammatic in nature and that various portions of bed 10 and the circuitry thereof is not depicted. However, a power source block 202 is intended to represent an onboard battery of bed 10 and an AC power cord of bed 10 as well as the associated power handling circuitry. Also, an other sensors block 204 is intended to represent all of the other sensors of bed 10 such as one or more sensors used to sense whether a caster braking system of bed 10 is in a braked or released position and such as sensors used to detect whether each of the siderails 48, 50 is raised or lowered, just to name a few.

Figure 3:
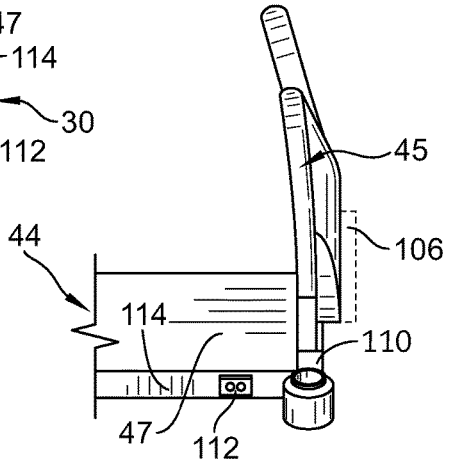
FIG. 3 is a side view of the footboard of FIG. 2 showing an outline of a portion of the space that receives the compression module.
Figure 4:
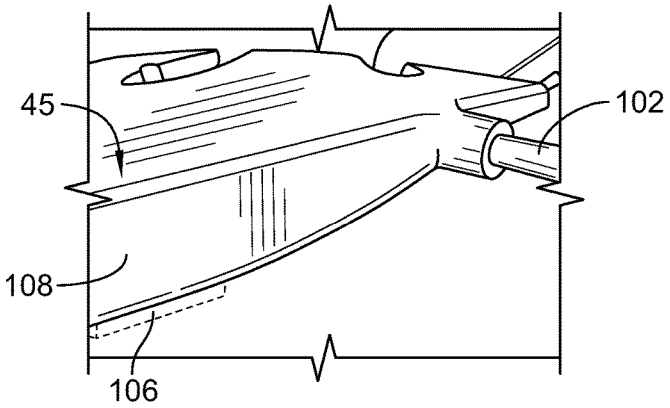
FIG. 4 is an enlarged perspective view of a bottom of the footboard showing an outline of a portion of the space that receives the compression module.

As mentioned previously, bed 10 includes compression therapy module 23 which operates to inflate and deflate one or more compression sleeves 25. Referring now to FIGS. 2-4, in some embodiments of bed 10, module 23 is located inside of footboard 45. Thus, module 23 is totally hidden from view when footboard 45 is mounted to frame 20 and, in particular, mounted to extender 47 of foot section 44. Footboard 45 has a pair of mounting posts 102, one of which can be seen in FIG. 4, that are received in sockets 104 shown in FIG. 2. A 14 inch-by-8 inch-by-4 inch space is depicted diagrammatically in FIGS. 2-4 by outline 106. Outline 106 represents the maximum space occupied by module 23 inside footboard 45 in the illustrative example of bed 10. As shown in FIG. 3, the particular prototype of footboard 45 needs to have its depth in the longitudinal dimension of bed 10 increased to accommodate module 23.

It should be appreciated that an electrical connector and a pneumatic connector which may be separate connectors in some embodiments and which may be a combined electrical/pneumatic connector in other embodiments, is provided at a bottom surface 108 of footboard 45. Mating electrical and pneumatic connectors are provided on frame 20 and, in particular, on an upper surface 110 at foot end 26 of extender 47 of foot section 44. Bed 10 includes a pair of sleeve ports 112 mounted to respective side surfaces 114 of extender 47 as shown in FIGS. 1-3. Compression sleeves 25 have conduits 113, such as tubes or hoses that are removably connectable to sleeve ports 112. In some embodiments, a multi-port connector is provided at the distal end of conduits 113 to permit simultaneous attachment of multiple conduits 113 to an associated sleeve port 112.

One or more pneumatic conduits, such as tubes or hoses, are routed from the pneumatic connector on surface 110 at the foot end 26 of extender 47 to each sleeve port 112 of the pair of sleeve ports 112. The first and second pneumatic connectors (i.e., the pneumatic connectors on the footboard 45 and extender 47) and the conduits routed to sleeve ports 112 are represented diagrammatically in FIG. 7 as dotted line 116. Electrical lines 118, indicated diagrammatically in FIG. 7, are routed to control circuitry 98 via the first and second electrical connectors (i.e., the pneumatic connectors on the footboard 45 and extender 47). Thus, electrical signals with commands and information are communicated between circuitry 98 and module 23. Thus, electrical lines 118 provide for bidirectional communication between circuitry 98 and module 23. The electrical lines 118 also provide power from power source 202 to control module 22 via control circuitry 98 in the illustrative example. Thus, no separate power cord is needed for compression module 23 because it receives power from the bed 10 in which it is integrated.

In some embodiments having module 23 situated within footboard 45, a lock 120 is provided at the interface between footboard 45 and extender 47. Lock 120 may comprise an extendable and retractable pin, such as a pin operated by a solenoid, or some other type of movable member such as a catch, hook, pawl, lever, or the like that is mounted on extender 47 and that is moved by an electrically operated driver to a locked position for receipt in an aperture, pocket, opening, or the like provided in footboard 45 to retain or lock footboard 45 on extender 47. Such an opening my comprise a hole or notch in one of mounting posts 102 of footboard 45, for example. The pin or other movable member is movable to a released position to permit footboard 45 to be detached from extender 47.

According to this disclosure, circuitry 98 sends one or more commands to lock 120 to signal lock 120 to operate in a locked mode having the pin or other movable member in the locked position when module 23 is turned on and operating to inflate and deflate one or more compression sleeves 25. When module 23 is turned off, circuitry 98 sends one or more commands to lock 120 to signal lock 120 to operate in a released or unlocked mode having the pin or other movable member in the released position so that footboard 45 is removable from extender 47 of foot section 44 of frame 20. Thus, during operation of module 23, footboard 45 cannot be removed from extender 47 in some embodiments.

Figure 5:
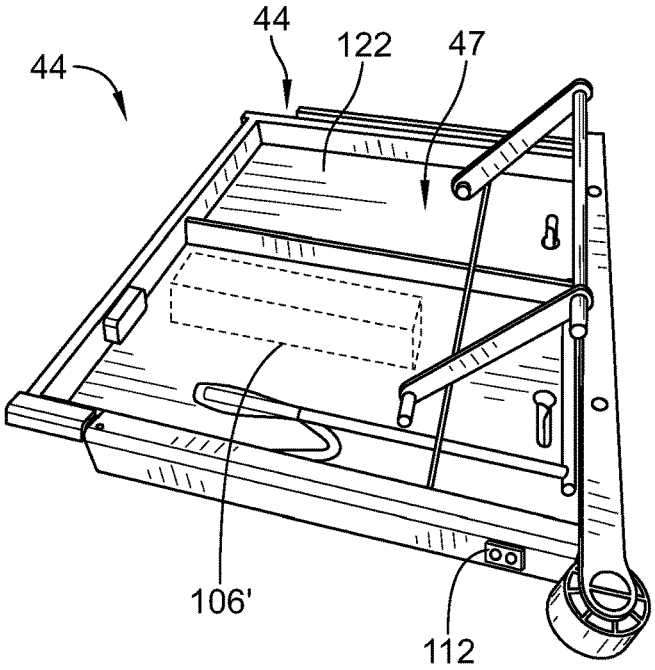
FIG. 5 is perspective view of an underside of a foot section of a mattress support deck of the patient bed of FIG. 1 showing an outline of a space on the underside of the foot section for receiving a compression module in an alternative embodiment.
Figure 6:
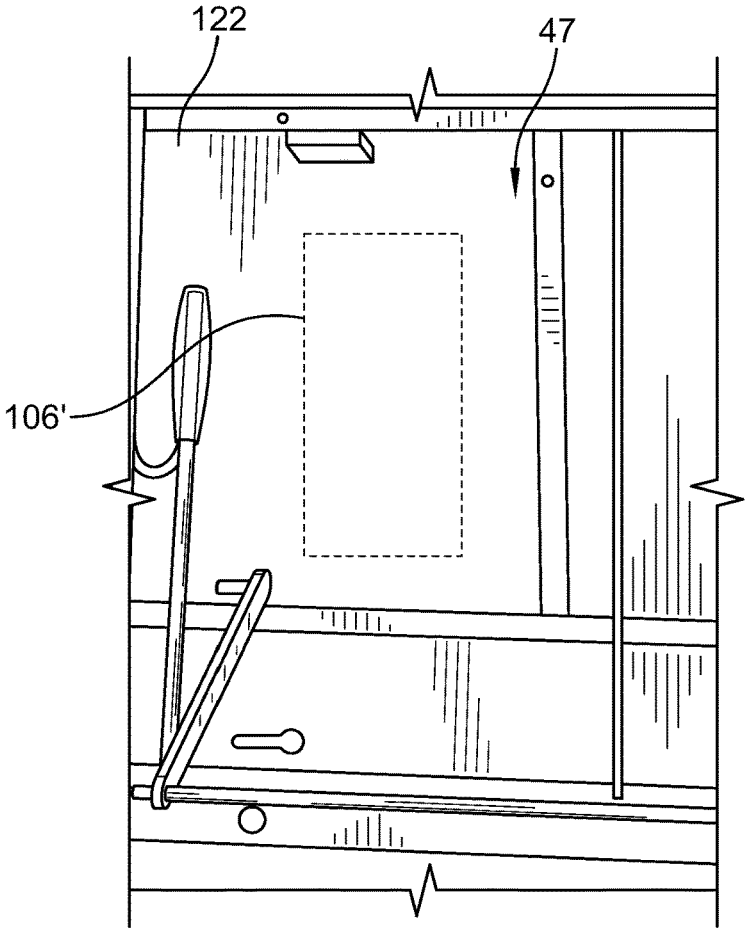
FIG. 6 is a bottom plan view of the foot section of FIG. 5 showing the outline of the space that receives the compression module.

Referring now to FIGS. 5 and 6, in some embodiments of bed 10, compression therapy module 23 is mounted to an underside or undersurface 122 of extender 47 of foot section 44. An 11 inch-by-8 inch-by-4 inch space is depicted diagrammatically in FIGS. 5 and 6 by outline 106'. Outline 106' represents the maximum space occupied by module 23 underneath extender 47 of foot section 44 in the illustrative example of bed 10. In the FIGS. 5 and 6 embodiment, the conduits extending between compression therapy module 23 and sleeve ports 112 do not require any intermediate pneumatic couplers like the embodiment of FIGS. 2-5, although this is not to exclude the possibility that such intermediate connectors may be used, if desired. Such conduits 116' are illustrated diagrammatically in FIG. 7. One or more electrical lines 118' extend between the compression therapy module 23 mounted to extender 47 and control circuitry 98 as indicated diagrammatically in FIG. 7. The discussion above of electrical lines 118 is equally applicable to electrical lines 118'.

Figure 8:
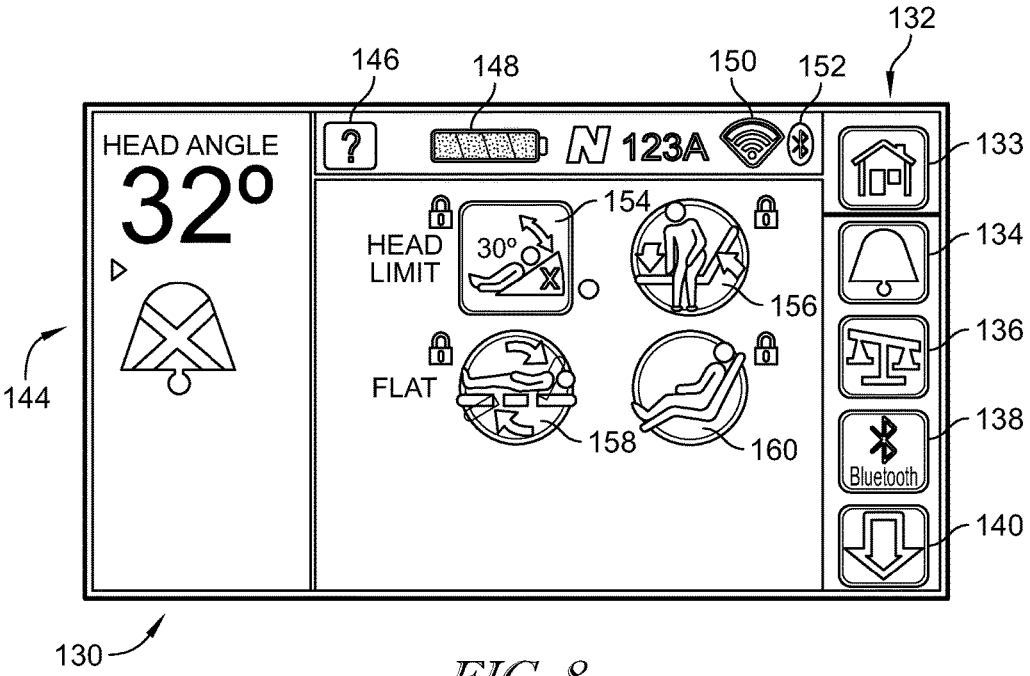
FIG. 8 is a screen shot of a home screen that appears on a graphical user interface (GUI) of the patient bed of FIG. 1, the home screen having a vertical menu bar on the right hand side of the screen.

Referring now to FIG. 8, a home screen 130 which appears on GUI 142 as a default screen includes a vertical menu bar 132 on the right hand side of screen 130. Menu bar 132 includes a home screen icon 133 which is selected to an alarm button or icon 134 which is selected to navigate to a screen that permits management of alarms of bed 10, a scale icon 136 which is pressed to navigate to a first scale screen of a plurality of scale screens, a Bluetooth icon 138 which is selected to navigate to a screen that permits management of Bluetooth connectivity between bed 10 and other devices, and a down arrow icon 140 which is selected to scroll to other icons of menu bar 132. On the left hand side of screen 130, a field indicates an angle at which head section 38 of bed 10 is elevated (32 degrees in the illustrative example) as measured by angle sensor 41 as described above. In the illustrative example, an alarm icon 144 with an "X" superimposed thereon appears beneath the angle measurement data on screen 130 to indicate that no alarms are occurring presently.

Screen 130 includes a horizontal informational bar across the top thereof which includes a help icon 146 which is selected to navigate to a first help screen of a plurality of help screens, a battery charge level icon 148 which indicates a level of charge of a battery of bed 10, an "N" icon which indicates successful communication with a nurse call system, a room number (e.g., room "123A" in the illustrative example), a WiFi icon 150 to indicate that the bed is in successful wireless communication with a WiFi access point of network 178, and a Bluetooth icon 152 to indicate that the bed is in successful wireless communication with at least one other Bluetooth-enabled device or component such as a communicator/locator unit mounted to a room wall.

Figure 9:
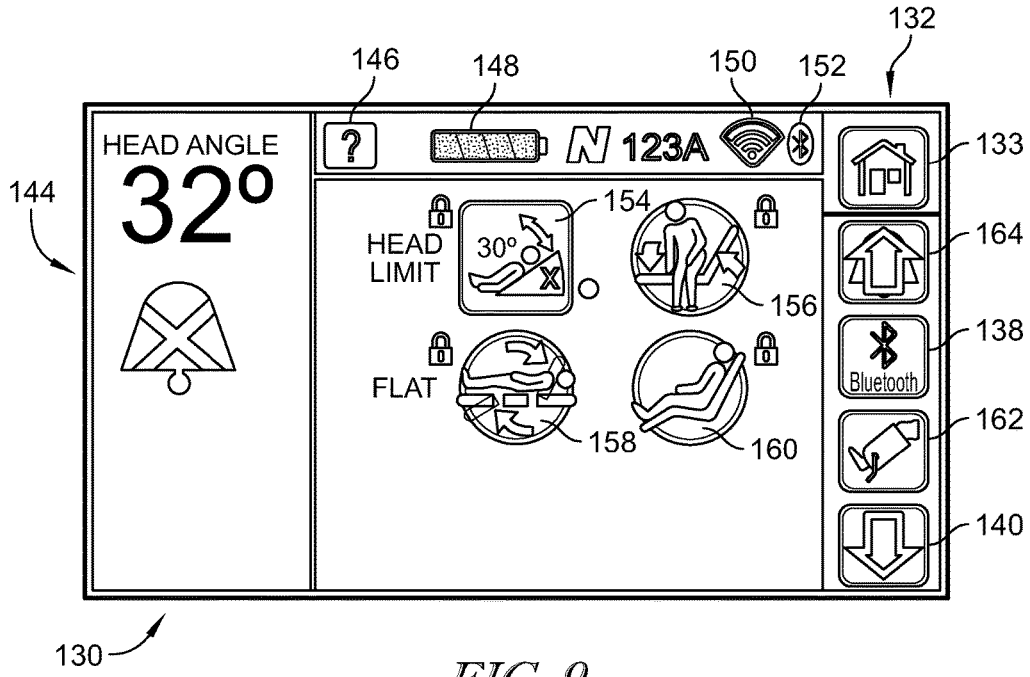
FIG. 9 is a screen shot showing the vertical menu bar at the right hand side of the screen scrolled so that a compression therapy icon appears on the menu bar.

Screen 130 also includes four user input buttons in a window or field beneath the horizontal informational bar as shown in FIGS. 8 and 9. The four buttons include a head limit button 154 which is selected to prevent the head section 40 of bed 10 from lowering to an elevation less than 30 degrees; a chair egress button 156 which is selected when a patient is about to egress from bed 10 to cause a seat region of mattress 22 to inflate to a higher target pressure (e.g., max inflate), to lower the thigh and foot sections 43, 44 if they are raised when button 156 is selected, and to raise head section 40 if it is lowered below a target elevation when button 156 is selected.

The four buttons also include a flat button 158 which is pressed to simultaneously move the head, thigh and foot sections 40, 43, 44 to a flat position relative to upper frame 39 (i.e., so as to be substantially coplanar with seat section 42) and a chair position button 160 which is selected to simultaneously move sections 40, 43, 44 into a chair position. It should be understood that the simultaneous movement occurs, if at all, for those sections 40, 43, 44 that are not already in the respective target orientations and that some sections 40, 43, 44 may continue to move after others have reached the respective target orientations. It should also be understood that movement of sections 40, 43, 44 of bed based on selection of buttons 156, 158, 160 results, in some embodiments, in pressure adjustments being made to one or more bladders or layers 73 by pneumatic system 72 based on signals from control circuitry 98. A lock out icon is situated adjacent to each of buttons 154, 156, 158, 160 on screen 130 and each lock out icon is lit or otherwise illuminated or displayed in a manner so as to indicate that the function of the associated button 154, 156, 158, 160 has been locked out and that the button 154, 156, 158, 160 cannot be used.

Figure 10:
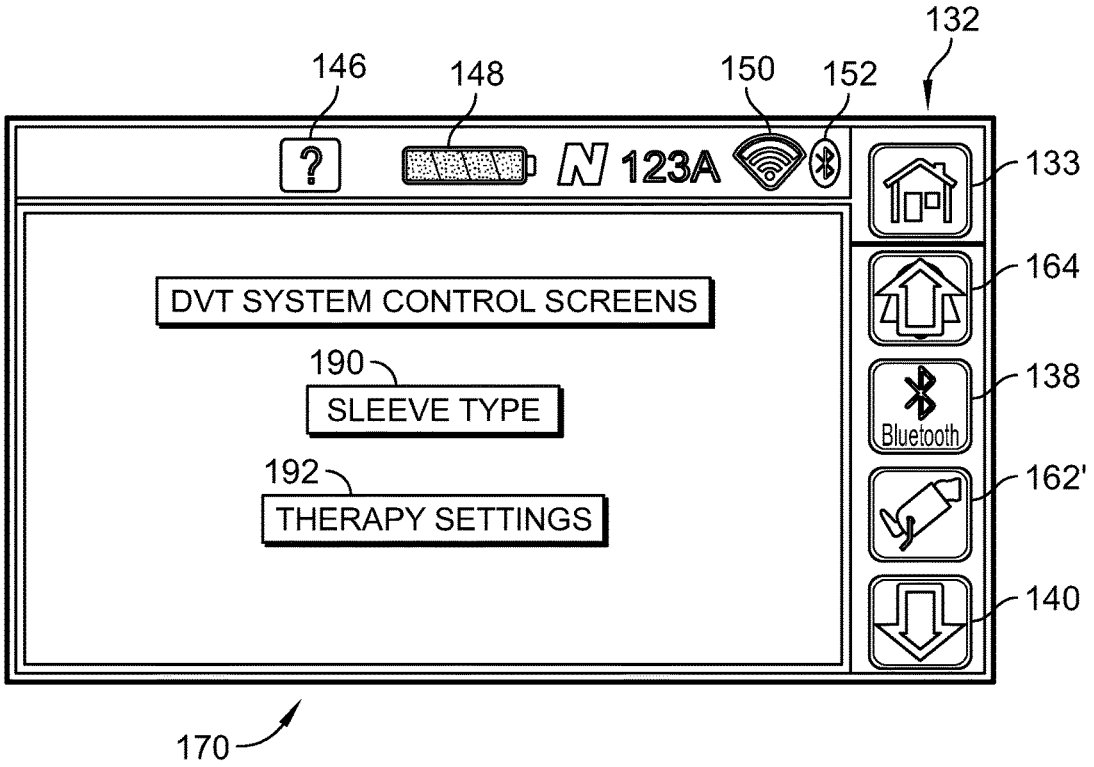
FIG. 10 is a screen shot of a generic compression therapy device control screen which appears on the GUI in response to selection of the compression therapy icon and which represents various screens used to control the compression therapy.

Referring now to FIG. 9, screen 130 appears but with menu bar 132 having been scrolled by one position so that a compression therapy icon 162 is included in menu bar 132 beneath icon 138 and above icon 140. An up arrow icon 164 also appears on menu bar 132 as a result of the scrolling of menu bar 132. Otherwise, screen 130 of FIG. 9 is the same as screen 130 of FIG. 8. In response to selection of icon or button 162 on screen 130, a first DVT System Control Screen 170 of a plurality of control screens for the compression device of bed 10 appears on GUI 142 as shown in FIG. 10. Screen 170 shown in FIG. 10 is a "generic" screen which is intended to represent all screens that are used to control operation of module 23 in connection with inflating and deflating one or more compression sleeves 25.

A sleeve type block 190 on screen 170 of FIG. 10 generically represents one or more sleeve type selection buttons that may appear on screen 170. For example, buttons for selection by a user of left and/or right foot sleeves, left and/or right calf sleeves, left and/or right thigh sleeves, or left and/or right combination sleeves such as those described above appear on screen 170 in some embodiments. It should be appreciated that the compression sleeve 25 on a patient's left leg may be of a different type than that on the patient's right leg. Alternatively or additionally, module 23 is operable to determine which type of sleeve is connected to each of ports 112 based on a time it takes to inflate a particular sleeve to a target pressure as measured by a pressure sensor of module 23. After module 23 makes the sleeve type determination for the one or more sleeves coupled to port(s) 112, that information is communicated to circuitry 98 which operates to display the sleeve type information on GUI 142.

Alternatively or additionally, sleeve ports 112 include sensors (e.g., Hall Effect sensors, RFID sensors, near field communication (NFC) sensors, or the like) to sense tokens (e.g., magnets, RFID tags, NFC tags, etc.) included as part of the connectors at the distal ends of conduits 113 of sleeves 25. The type of sleeve is sensed by such sensors of each of sleeve ports 112 and communicated to module 23 which, in turn, communicates the sleeve type information to circuitry 98 for ultimate display on GUI in connection with the compression device control screens 170.

A therapy settings block 192 on screen 170 of FIG. 10 generically represents various therapy setting buttons or icons or therapy data entry fields or menus that appear on screen 170. The selectable therapy settings selectable by these various type of user inputs include, for example, the target pressure to which each sleeve 25 is to be inflated by module 23 or to which each zone of each sleeve 25 is to be inflated by module 23 if sleeve 23 has multiple zones which is oftentimes the case for sleeves used for sequential compression therapy. The selectable therapy settings further include, for example, the frequency of inflation or deflation and/or the duty cycle of the inflation/deflation cycles as well as the number of cycles or the time period over which the compression therapy is to take place. In some embodiments, the selectable therapy settings include selection of pressure versus time curves (e.g., step up and/or step down curves, ramp up and/or ramp down curves, saw tooth curves, and the like) as well as the parameters for the various types of curves (e.g., pressure setting at each step, duration of each step, duration of ramp up, duration of ramp down, and the like).

According to the present disclosure, the manner in which compression therapy is delivered by module 23 to one or more sleeves 25 is varied in response to movement of bed components or in response to conditions detected by sensors of bed 10. When it is stated that the manner of compression therapy is varied, it means that at least one parameter of operation of module 23 such as a target pressure, a frequency of inflation or deflation, a duration of inflation or deflation, a duty cycle of inflation and deflation, a number of cycles or a time period of compression therapy, a step parameter or a ramp parameter is adjusted either by increasing the particular parameter(s) or decreasing the particular parameter(s).

For example, control circuitry 98 varies an operating parameter of compression therapy of the compression therapy module 23 depending upon the angle of head section 40 as sensed by angle sensor 41 in some embodiments. The adjustment may be proportional to the angle sensed by angle sensor 41 (e.g., target pressure is a function of head angle) or the adjustment may be based on a look up table which correlates a target pressure or target pressure adjustment offset with the head angle. For example, a first target pressure for sleeve 25 is used when head section 40 is elevated from 0 degrees to 30 degrees, a second target pressure is used when head section 40 is elevated from 30 degrees to 50 degrees and a third target pressure is used when head section 40 is above 50 degrees, just to give one arbitrary example. Alternatively or additionally, a duty cycle of inflation/deflation may be adjusted so that the sleeves 25 are inflated for a longer period of time or a shorter period of time within each inflation/deflation cycle. Similar adjustments may be made to the operating parameters of compression therapy based on movement of one or more of sections 43, 44 of bed 10. The adjustment is made to compensate for changing elevation of the patient's heart relative to the patient's legs which may have a tendency to affect the blood flow within the patient's legs.

As another example of varying the manner in which compression therapy is delivered to a patient, control circuitry 98 varies an operating parameter of compression therapy of the compression therapy module 23 depending upon the weight of the patient sensed by the scale system 270. Thus, a heavier patient may have higher target pressures established for sleeves 112 than a lighter patient. In some embodiments in which scale system 270 also serves as a patient position and/or bed exit monitoring system, or in embodiments having some other type of patient position and/or bed exit monitoring system, control circuitry 98 signals the compression therapy module 23 to cease operating if the patient is sensed by the patient position monitoring system to have violated a boundary condition such as being out of position or moving toward exiting bed 10. Alternatively or additionally, circuitry 98 may signal compression therapy module 23 to cease operating in response to one or more of siderails 49, 50 being moved out of its raised position and/or in response to side egress button 156 being selected. In these scenarios, the assumption is that a caregiver is present in the room and is getting ready to help the patient to get out of bed 10.

In some embodiments, control circuitry 98 receives information communicated from remote computer 176 over network 178 and varies an operating parameter of compression therapy of the compression therapy module 23 depending upon the information received from the remote computer. For example, computer 176 may send information to bed 10 indicating that the patient is scheduled for labs or physical therapy or an X-ray or discharge from the healthcare facility at a certain time of day. In response to this information, circuitry 98 may signal compression module 23 to cease operation a threshold amount of time, selectable by a user in some embodiments, such as 15 or 30 minutes prior to the scheduled event. In this scenario, the assumption is that a caregiver will soon be arriving to remove the patient from bed 10 and taking the patient to the scheduled event.

As another example, computer 176 may determine that the patient on bed 10 has become at elevated risk for developing a pressure ulcer, possibly due to conditions sensed on bed 10 such as lack of movement, incontinence, skin shear due to number of movements of one or more of sections 40, 43, 44, use of a heel relief function of mattress 22, and so on. In response to information regarding the elevated risk of developing a pressure ulcer being communicated to bed 10, circuitry 98 communicates the information to module 23 which may decrease a target pressure of compression therapy or reduce the number of cycles or time period of compression therapy.

According to this disclosure, control circuity 98 is configured to send information regarding usage of the compression therapy module 23 to remote computer 176 over network 178. Alternatively or additionally, control circuitry 98 is configured to send information regarding usage of the compression therapy module 23 to in-room display 181 which is spaced from bed 10. The in-room display 181 may comprise a graphical station of a nurse call system or it may comprise an in-room computer or it may comprise a hand held computer device such as a phone, laptop computer, or tablet computer. In some embodiments, control circuitry 98 is configured to lock out at least one bed function in response to the compression therapy module 23 being in use. For example, the at least one bed function that may be locked out may include movement of at least one deck section 40, 43, 44 of the plurality of deck sections.

In some embodiments, alarms 185 are activated in response to alarm conditions associated with compression module 23. Such alarm conditions may include high temperature within module 23, an electrical short in module 23, high current or voltage in module 23, pressure sensor failure within module 23, and so on. Alternatively or additionally, alarm messages and error messages regarding the operation of module 23 are displayed on GUI 142 in some embodiments.

In one contemplated embodiment, module 23 and sleeves 25 are made by Encompass Group LLC and are similar in construction and function to the LOGIX™ PULSTAR® DVT Prevention System which is marketed by the ALBA-HEALTH® division of Encompass Group LLC. In this contemplated embodiment, GUI 142 of bed 10 displays screens 170 that are substantially similar to the screens that appear on a display screen of the LOGIX™ PULSTAR® device. However, whereas the display screen of the LOGIX™ PULSTAR® device is not a touchscreen display but instead uses manual buttons adjacent to the display screen, the manual buttons of the LOGIX™ PULSTAR® device are fashioned as touchscreen inputs on GUI 142 of bed 10.

Figure 11:
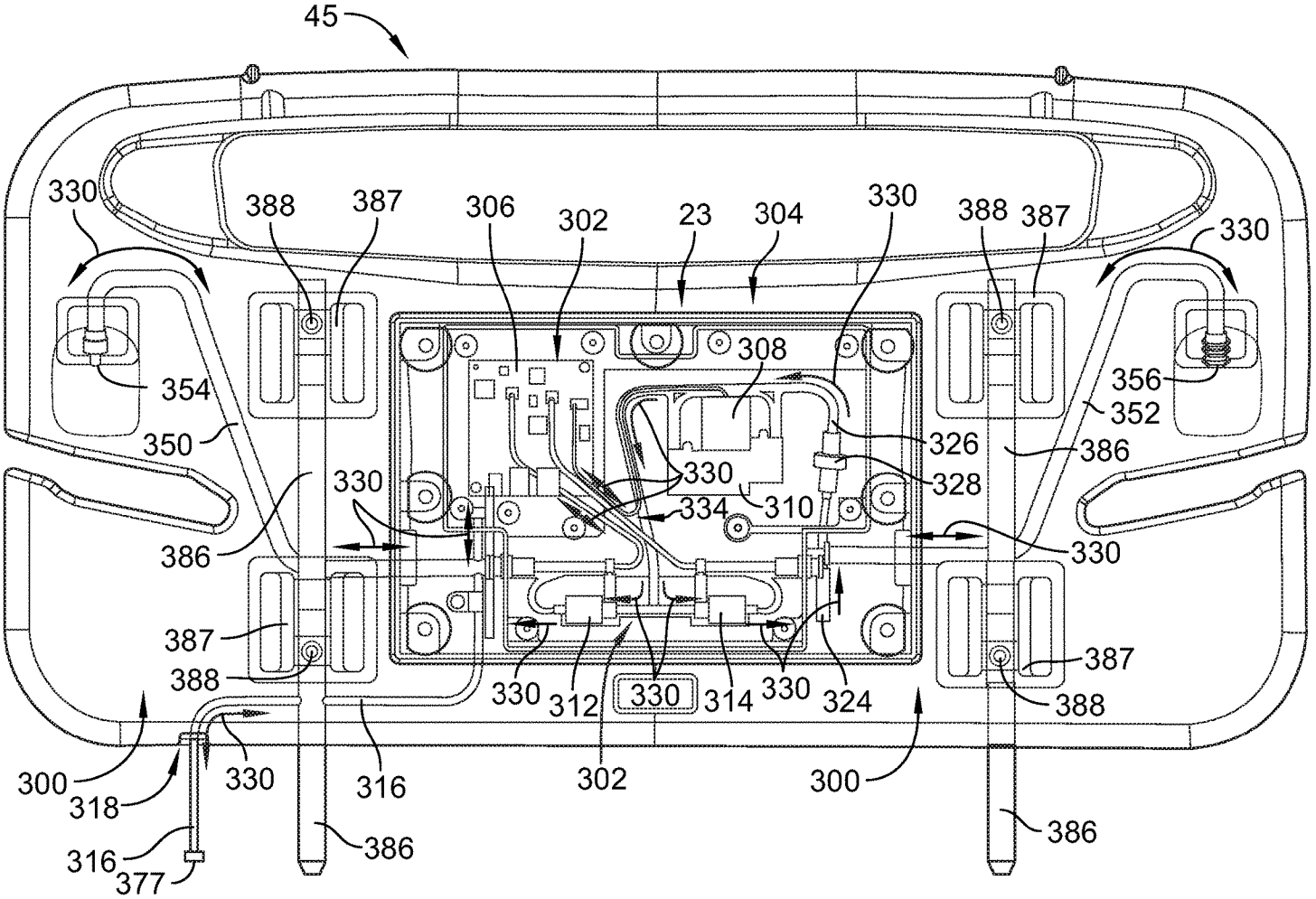
FIG. 11 is cross sectional view of a footboard having a compression module integrated therein showing a set of arrows to indicate air flow into and out of an interior region of the footboard from ambient atmosphere and into and out of the compression module from the interior region of the footboard.

Referring now to FIG. 11, footboard 45 is shown in cross section and has compression therapy module 23, sometimes referred to as compression module 23 or just module 23, mounted therein. Footboard 45 has an interior region 300 and compression therapy module 23 has a housing 304 with an interior region 302. Housing 304 of module 23 is received in a portion 300' of interior region 300 of footboard 45 which is generally rectangular in shape as defined by boundary walls 305, two of which can be seen in FIG. 15, of footboard 45. Footboard 45 includes a pair of posts 386 that mount to reinforced portions 387 of footboard 45 in interior region 300 using suitable fasteners 388 such as screw, bolts, or rivets. Lower regions of posts 386 extend downwardly from a bottom of footboard 45 and are configured for receipt in mating sockets of frame 30 of bed 10 as is generally known in the art.

Figure 12:
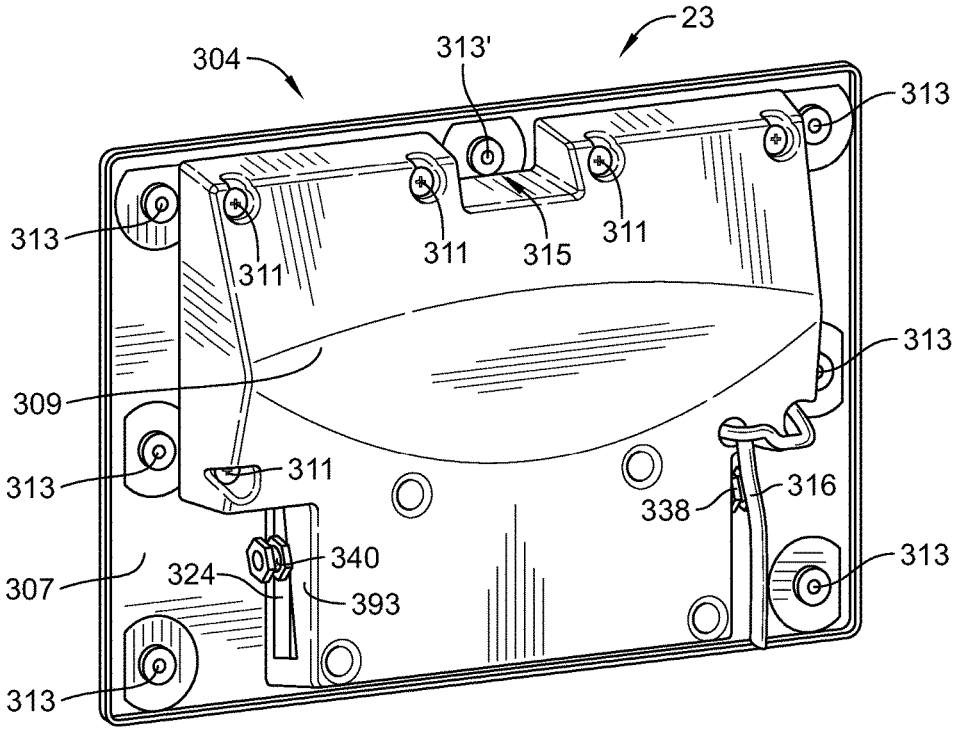
FIG. 12 is a rear perspective view showing a rear of a housing of the compression module of FIG. 11.
Figure 13:
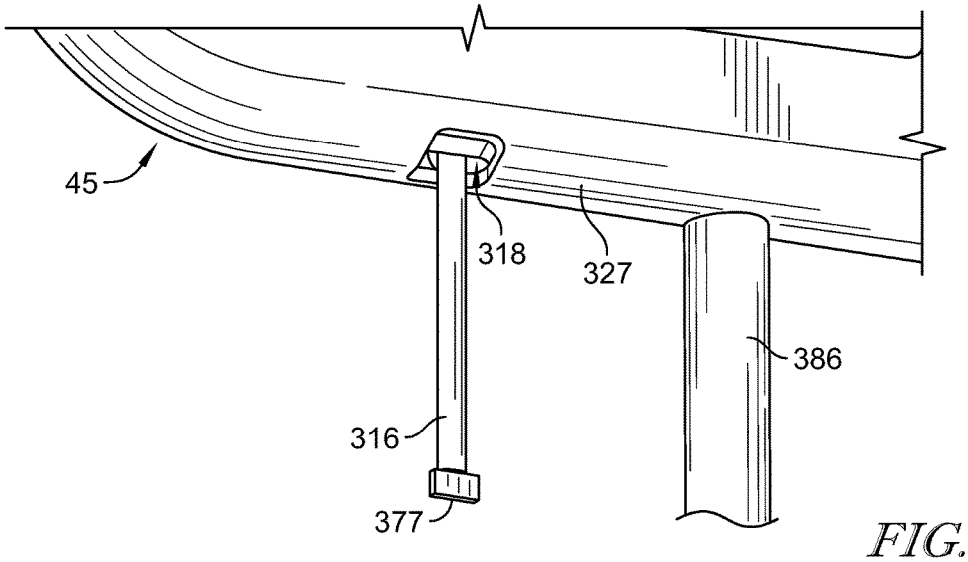
FIG. 13 is an enlarged perspective view of a bottom region of the footboard of FIG. 11 showing an electrical cable hanging downwardly through a hole in the bottom of the footboard and showing the hole being sufficiently large to permit air to enter and exit the interior region of the footboard around the cable.
Figure 15:
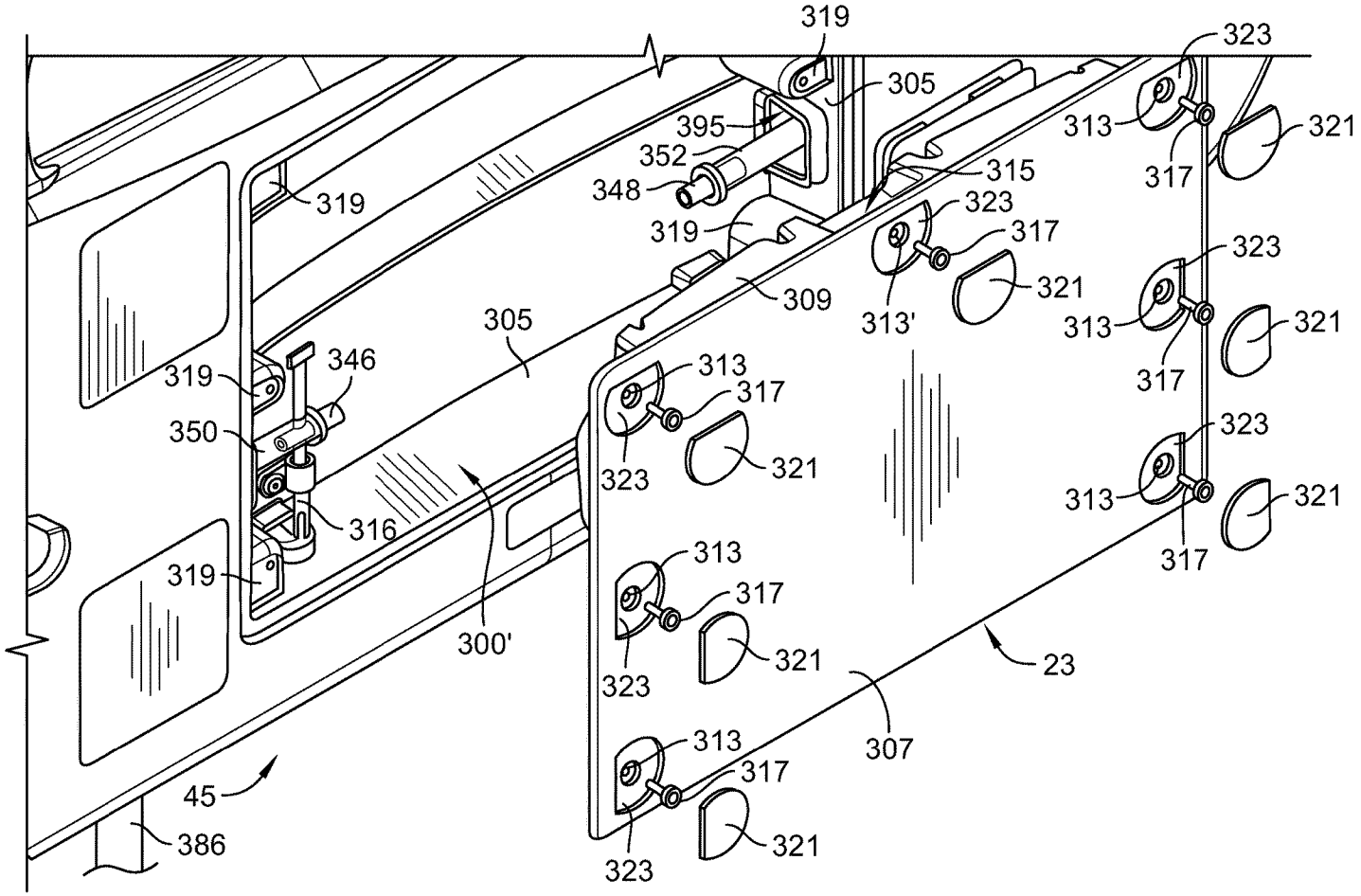
FIG. 15 is an enlarged perspective view showing the compression module of FIGS. 11 and 12 arranged for insertion into a module-receiving cavity of the footboard.

Housing 304 includes a generally flat face plate 307 and a shaped rear shell 309 that mounts to a rear of face plate 307 with suitable fasteners such as bolts or screws 311 as shown in FIG. 12. Interior region 302 of module 23 is defined between rear shell 309 and face plate 307. Compression module 23 is sometimes referred to a pod or a cartridge and any of these synonyms serves as a suitable definition of the others in accordance with this disclosure. Face plate 307 extends beyond the sides of rear shell 309 and the peripheral side portions of face plate 307 each have a set of holes 313 formed therethrough as shown in FIGS. 12 and 15. An upper wall of shell 309 is formed to include a central notch 315 through which an additional hole 313' formed in the top, central region of face plate 307 is accessible at the rear of housing 304. Suitable fasteners 317, such as screws or bolts, extend through holes 313, 313' and thread into respective bosses 319 which are located in portion 300' of interior region 302 adjacent to boundary walls 305 as show in FIG. 15 (portions of only five of the seven bosses 319 can be seen in FIG. 15). Thus, fasteners 317 mount housing 304 of module 23 to footboard 45 in the illustrated example.

Covers or plugs 321 are received in complementary shaped depressions or recesses 323 formed in a front of face plate 307 to block access to fasteners 317 after module 23 is mounted to footboard 45. Covers 321 are press fit into depressions 323 and/or have adhesive backing for retention in depressions 323. Thus, once installed in footboard 45, module 23 of FIGS. 11-15 can only be removed with the use of tools and only after covers 321 are destructively removed from depressions 323 in some instances. In this regard, module 23 of FIGS. 11-15 is considered to be permanently mounted or permanently coupled to footboard 45 according to the present disclosure. Furthermore, it is contemplated by this disclosure that the connection between the generally rectangular outer periphery of face plate 307 and the generally rectangular opening in footboard 45 to portion 300' of interior region 300 forms a substantially airtight and watertight seal.

Figure 14:
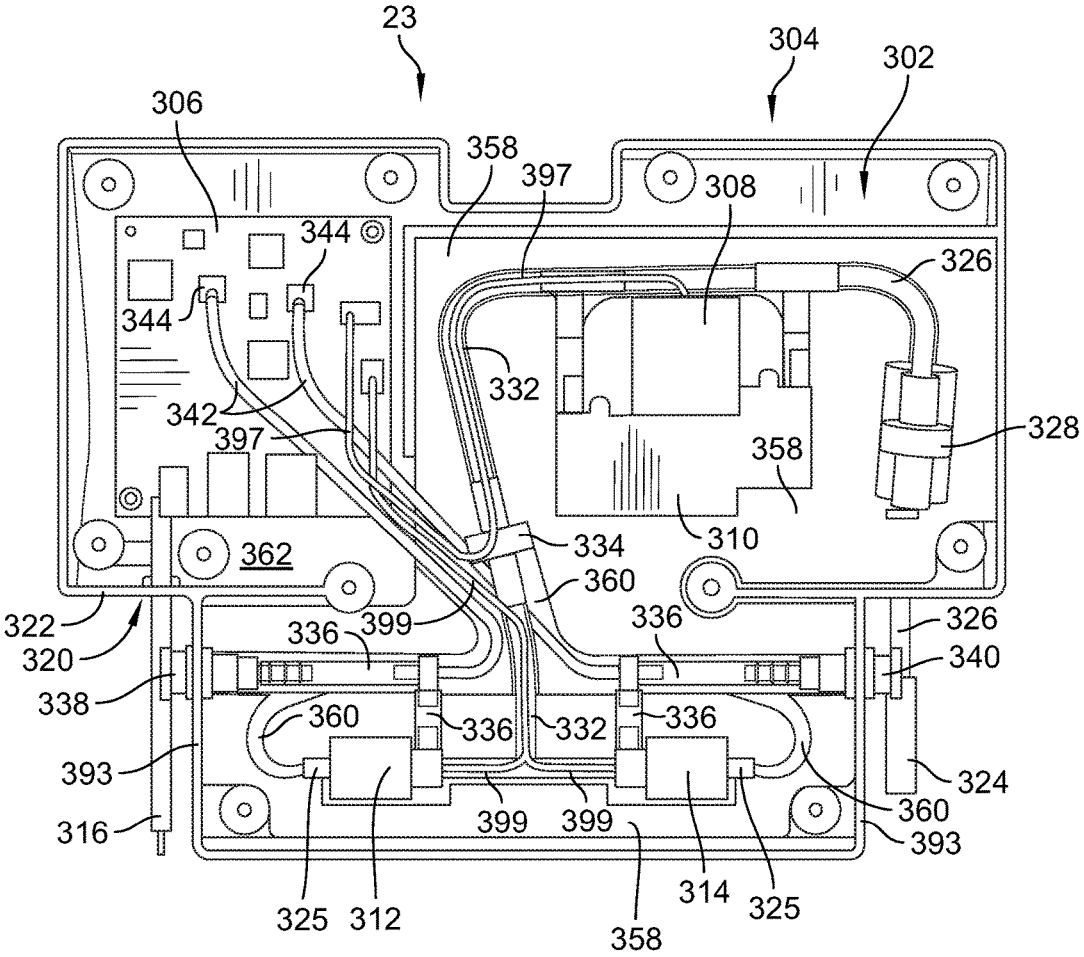
FIG. 14 is cross sectional view of the compression module of FIGS. 11 and 12 showing internal components of the compression module.

Referring now to FIGS. 11 and 14, module 23 includes a circuit board 306 (aka circuitry 306) that controls the operation of a motor 308 of a pump 310 of module 23 with signals provided on a wire 397 or other suitable conductor. Module 23 also includes a first solenoid 312 and a second solenoid 314 that are controlled by circuitry of circuit board 306 via respective wires or conductors 399. An electrical cable 316 is routed into interior region 300 of footboard 45 through an opening 318 formed in a bottom wall 327 of footboard 45, as shown best in FIG. 13, and through interior regions 300, 300' of footboard 45 to circuit board 306 though an opening 320 provided in a wall 322 of housing 304 as shown best in FIG. 14. Openings 318, 320 are each larger than an outer diameter of cable 316 so as to provide air passageways into and out of interior region 300 of footboard 45 and into and out of interior region 302 of housing 304. Passageways or openings 395 are provided in opposite sidewalls 305 to permit air to flow between interior region 300 and interior region 300'.

Module 23 includes an air inlet 324, illustratively a tube, which is in pneumatic communication with an inlet of pump 310 via additional associated tubing 326 and a filter 328 as shown in FIGS. 11 and 14. Thus, during operation of pump 310 to inflate the associated compression sleeves 25, ambient air is drawn into interior region 300 through opening 318, then through openings 395 from interior region 300 into interior region 300', and then into air inlet 324. The air drawn into inlet 324 by pump 310 moves into interior region 302 of module 23 through tubing 326 prior to reaching filter 328. When pump 310 is operating to inflate sleeves 25, pressurized air is provided through associated hoses 332 and a filter 334 to solenoids 312, 314 which are signaled by control circuitry of circuit board 306 via conductors 399 to operate in a first position directing the pressurized air through associated hoses 336 to respective first and second hose connectors 338, 340 which are accessible adjacent opposite sidewalls 393 of shell 309 of housing 304 as shown in FIGS. 12 and 14 (only one of sidewalls 393 can be seen in FIG. 12). Module 23 includes a pair of pressure hoses 342 that tap into a junction between associated pairs of hoses 336 that are coupled to respective solenoids 312, 314. Pressure hoses 342 lead from their respective junctions to pressure sensors 344 of circuit board 306 as shown in FIG. 14.

Portions of hose connectors 338, 340 are located outside of housing 304, as shown best in FIG. 12, so as to be exposed for coupling to mating connectors 346, 348, shown best in FIG. 15, that are provided at respective inboard ends of first and second hoses 350, 352. Hoses 350, 352 extend through openings 395 from interior region 300' into interior region 300 of footboard 45 and terminate at respective connectors or ports 354, 356 at the outboard ends of hoses 350, 352 as shown in FIG. 11. Connectors 354, 356 project from footboard 45 at a somewhat downward angle toward the patient supported by the associated bed 10. Conduits 113 extending from sleeves 25 connect to ports 354, 356 to receive pressurized air from pump 310.

If only one sleeve 25 is being inflated by pump 310, then after a predetermined period of time, the pressures sensed by pressure sensors 344 will be used by the control circuitry to determine which of ports 354, 356 is connected to a compression sleeve 25 and which is not. The solenoid 312, 314 associated with the open port 354, 356 that is not connected to a sleeve 25 will be signaled by the control circuitry to move to a position blocking pressurized air from reaching the open port 354, 356. Additional details of ports 354, 356 and another embodiment of a compression therapy module are shown and described in International Publication No. WO 2016/196403 A1 which is hereby incorporated by reference herein, in particular with regard to FIGS. 139-143 and FIGS. 355-375 and the related descriptions of those Figs. which includes paragraphs [00530] and [00531].

At the end of the compression therapy, the solenoids 312, 314 associated with ports 354, 356 that are connected to sleeves 25 are signaled by the control circuitry via conductors 399 to move to a position allowing air to flow from sleeves 24, through connectors 354, 356, associated hoses 350, 352, connectors 338, 340, and associated hoses 336 to escape from respective outlets 325 of solenoids 312, 314 into the interior region 302 of housing 304. Housing 304 is packed with sound reducing foam 358. Foam 358 is formed to include a series of passageways 360 including passageways 360 leading from outlets 325 of solenoids 312, 314 into a space 362 around circuit board 306 which communicates with opening 320. Space 362 is part of the interior region 302 of housing 304. Thus, air exiting outlets 325 of solenoids 312, 314 is able to escape from interior region 302 into interior region 300' of footboard 45, then into interior region 300 of footboard 45, and ultimately, to the ambient surroundings through opening 318 of footboard.

Various arrows 330 are shown diagrammatically in FIG. 11 to represent the air flow through the various spaces, passageways, tubing, etc. during inflation and deflation of compression sleeves 25 including through openings 318, 320 and 395. Suitable strain reliefs are provided near openings 318, 320 to hold cable 316 in place at these locations and are provided near openings 395 to hold hoses 350, 352 in place at these locations, while at the same time permitting sufficient slack in cable 316 and hoses 350, 352 to permit them to be manipulated to make the connections with module 23 during installation of module 23 in footboard 45.

In the embodiment of FIGS. 11-15, circuitry 306 of module 23 communicates with circuitry 98 of bed 10 and receives power from circuitry 98 of bed 10 via cable 316. In some embodiments, footboard 45 is secured to bed 10, such as being bolted to foot section portion 47. As such, it is not intended for footboard 45 to be removed from bed 10 during ordinary usage. In such embodiments, it is possible for cable 316 to be routed from module 23 all the way to circuitry 98, or at least to a connector provided in close proximity to circuitry 98. In other embodiments, however, to permit detachment of footboard 45 from bed 10, cable 316 terminates at a connector 377 which plugs into a mating connector on bed 10. Such a mating connector may be mounted at or near the foot end 26 of portion 47 of deck 38, for example. Alternatively, matting connectors may be provided between a bottom of footboard 45 and the underlying bed support structure such as is shown in U.S. Pat. No. 6,208,250 which is hereby incorporated by reference herein with regard to elements 52, 54 which are shown and described in connection with FIGS. 1-3 and 14-16.

Additional electrical conductors are routed from the mating connector of connector 377 to circuitry 98 of bed 10 in such embodiments. In either case, there is wired communication and wired power transfer between bed 10 and module 23 in the embodiment of FIGS. 11-15. Cable 316 includes electrical conductors that are among the conductors interconnecting circuitry 306 of module 23 and circuitry 98 of bed 10. It should be appreciated that, inputs entered on GUI 142 of bed 10 pertaining to module 23 are communicated from circuitry 98 to circuitry 306 via cable 316. Information regarding the operation of module 23 are communicated from circuitry 306 of module 23 to circuitry 98 of bed 10 via cable 316.

It is contemplated by this disclosure that modules 23 manufactured by different companies and/or modules 23 manufactured by the same company but having different features and functions may be attached to footboard 45 in the allotted space 300' of footboard 45. When a particular pod or module 23 is installed, cable 316 is electrically coupled the module 23 and hoses 350, 352 are pneumatically coupled to the module being installed. Circuitry 98 of bed 10 receives information from the circuitry 306 of the particular module which identifies the module type (e.g., model no., manufacturer, etc.). Thus, bed 10 senses the type of module 23 installed in footboard 45. Circuitry 98 of bed then uses the proper software to communicatively interface with the type of module 23 installed.

In some embodiments, software for all potential types of modules 23 that may be installed in footboard 45 is preloaded and stored in memory 174 of circuitry 98. Once the type of module 23 has been determined by circuitry 98, the corresponding software for the particular type of module is then used by circuitry 98 in connection with communicating with module 23 and in connection with presenting user interface screens on GUI 142. Alternatively or additionally, circuitry 306 of each module 23 stores the particular software that bed circuitry 98 needs for interfacing with the particular type of module 23 and then circuitry 306 downloads the software to circuitry 98 via cable 316 after it is connected to the particular module 23. Further alternatively or additionally, after bed circuitry 98 determines the type of module 23 installed in footboard 45, circuitry 98 downloads the appropriate software for the type of module 23 from a remote computer or server having the appropriate software stored therein.

Figure 16:
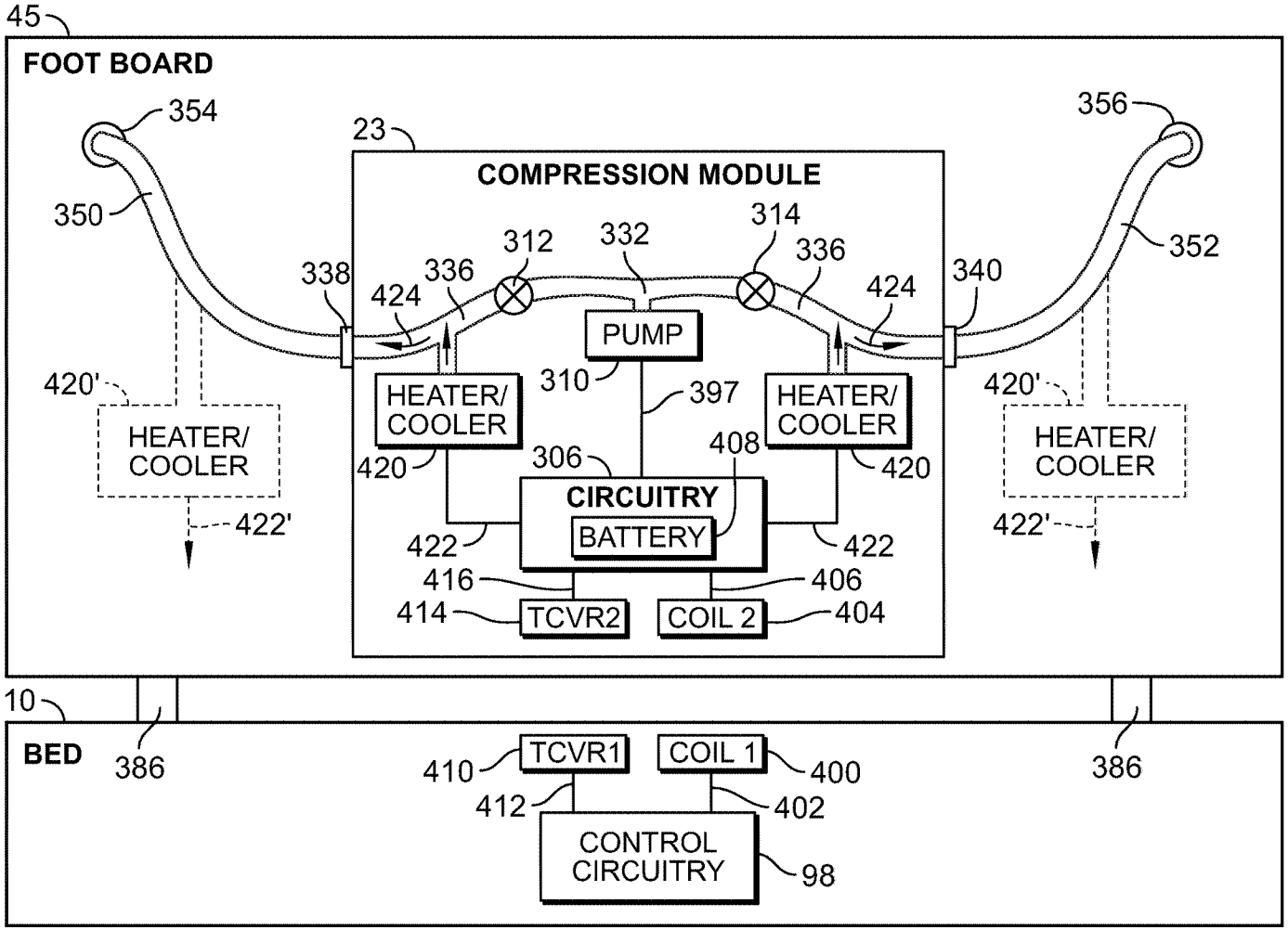
FIG. 16 is a block diagram of an alternative embodiment of a compression module showing that the compression module receives power wirelessly from the bed circuitry via inductively coupled coils and that communicates wirelessly with the bed circuitry via communicatively coupled transceivers and showing a set of heater/cooler units to introduce heated and/or cooled air into the air flow between the pump and a pair of connectors to which respective compression sleeves couple.

Referring now to FIG. 16, an alternative embodiment is shown in which circuitry 306 of compression module 23 receives power wirelessly from bed circuitry 98 and communicates wirelessly with bed circuitry 98. In this regard, a first coil 400 is carried on bed 10, such as on portion 47 of deck 38 near the foot end 26 of bed 10, and is coupled to bed circuitry 98 via a wired connection 402. A second coil 404 is carried by compression module 23, such as near the bottom of housing 304, and is coupled via a wired connection 406 to circuitry 306. In a further optional variant, coil 404 is carried by the footboard 45 and is wired into the compression module 23 via a suitable electrical conductor leading to circuitry 306. The first and second coils 400, 402 are inductively coupled coils so that power is transferred from bed 10 to module 23. In the illustrative example, circuitry 306 includes a battery 408 that is charged with the power provided wirelessly to coil 404 by coil 400. In other embodiments, circuitry 306 does not include battery 408 and the various electrical components (e.g., circuitry 306, motor 308 of pump 310, and solenoids 312, 314) of module 23 are powered directly from coil 404, optionally with an intervening voltage controller or voltage divider or the like.

With regard to wireless communication between bed 10 and module 23, a first transceiver 410 is carried on bed 10 such as on portion 47 of deck 38 near the foot end 26 of bed 10, and is coupled to bed circuitry 98 via a wired connection 412. A second transceiver 414 is carried by compression module 23, such as near the bottom of housing 304, and is coupled via a wired connection 416 to circuitry 306. In further optional variants, transceiver 414 is carried by circuit board 306 or is carried by the footboard 45 and is wired into the compression module 23 via a suitable electrical conductor leading to circuitry 306.

Transceivers 410, 414 communicate bidirectionally such that data transmitted from circuitry 306 via transceiver 414 is received by circuitry 98 of bed 10 and such that data transmitted from circuitry 98 via transceiver 410 is received by circuitry 306 of module 23. All suitable types of wireless communication protocols are contemplated by the present disclosure for circuitry 98, 306 and transceivers 410, 414, including, but not limited to, Bluetooth, Bluetooth Low Energy (BLE), IEEE 802.11 of all types, and Zigbee protocols. Any of the data and/or software transmissions made using cable 316 discussed above, can be made wirelessly via transceivers 410, 414. In another embodiment, transceivers 410, 414 are omitted and data and/or software transmissions are made between coils 400, 404 such that data, software, and power is provided over the same wireless link.

Still referring to FIG. 16, a set of heater/cooler units 420 are provided to introduce heated and/or cooled air into the air flow between pump 332 and the connectors 354, 356 to which respective compression sleeves 25 couple. Thus, units 420 comprise a heater or a cooler or both according to the present disclosure. In the illustrative example, units 420 are controlled by circuitry 306 via respective wired connections 422. Arrows 424 diagrammatically indicate the heated or cooled air that is introduced by units 420 into the air flow from pump 310. In some embodiments, temperature sensors are provided at a suitable location, such as within units 420 or in one or more of conduits 336, 350, 352, or in one or more of connectors 338, 340, 354, 356. Signals from the temperature sensors are used by circuitry 306 for feedback control of units 420 so as to maintain the air flow to sleeves 25 at a target temperature within a suitable tolerance range.

In the illustrative example, units 420 are located inside compression module 23. Alternatively or additionally, heater/cooler units 420' are located outside of compression module 23 but within footboard 45 as indicated in FIG. 16 (in dotted line). In other embodiments, such as those discussed above in connection with FIGS. 5-7 having module 23 coupled to foot section 44 of bed 10, units 420 are included in the module 23 mounted to foot section 44 and/or units 420' are mounted to foot section 44 separately from the associated module 23. In such cases, heated and/or cooled air, as the case may be, is introduced into the flow of air to that ports 112 that are mounted to foot section 44.

Referring again to FIG. 16, units 420' introduce heated or cooled air into the air flow from pump 310 via pneumatic couplings with conduits 350, 352. Each of units 420' has a wired connection 422' which leads to either circuitry 306 or circuitry 98 or both. In some embodiments, units 420, 420' communicate unidirectionally or bidirectionally with circuitry 98 via transceivers 410, 414. Thus, it is within the scope of the present disclosure for software control of units 420, 420' to be undertaken by either circuitry 306 or circuitry 98 or both. In a further variant, only one unit 420, 420' is provided for introducing heated or cooled air into the pneumatic system of module 23. For example, in some embodiments, a single unit 420, 420' is coupled to air inlet 324 such that the air flow reaching the inlet of pump 310 is already heated or cooled.

Although certain illustrative embodiments have been described in detail above, many embodiments, variations and modifications are possible that are still within the scope and spirit of this disclosure as described herein and as defined in the following claims.

The invention claimed is:

1. A patient support apparatus comprising a frame including a patient support deck, control circuitry carried by the frame, a footboard coupled to the frame and having a first interior region, a compression module located within an interior region of the footboard, the compression module having a housing and a second interior region in the housing, the second interior region being in pneumatic communication with the first interior region through at least one first opening in the housing, a sleeve port pneumatically coupled to the compression module, the sleeve port being configured for attachment to at least one tube extending from a compression sleeve that is worn on a limb of a patient, and an electrical cable providing wired communication between the compression module and the control circuitry, the electrical cable extending through a second opening formed in the footboard, wherein during operation of the compression module to inflate the compression sleeve, air moves from ambient surroundings into the first interior region of the footboard through the second opening and air moves into the second interior region in the housing of the compression module through the at least one first opening, wherein the compression module includes a filter and a pump and air entering the second interior region through the at least one first opening passes through the filter before reaching the pump.

2. The patient support apparatus of claim 1, wherein during operation of the compression module to deflate the compression sleeve, air exits from the second interior region of the housing of the compression module into the first interior region of the footboard and air exits from the first interior region of the footboard into the ambient surroundings through the second opening.

3. The patient support apparatus of claim 1, wherein the footboard has a bottom wall and the second opening is provided in the bottom wall.

4. The patient support apparatus of claim 1, wherein the sleeve port is attached to the footboard.

5. The patient support apparatus of claim 1, wherein a hose extends between the compression module and the sleeve port through the first interior region of the footboard.

6. The patient support apparatus of claim 1, wherein the electrical cable extends through the at least one first opening of the housing of the compression module.

7. The patient support apparatus of claim 1, wherein the compression module is permanently mounted to the footboard.

8. The patient support apparatus of claim 1, wherein the compression module carries a heater unit in the second interior region and the heater unit is operable to introduce heated air into a flow of air to the sleeve port.

9. The patient support apparatus of claim 1, wherein the footboard carries a heater unit in the first interior region and the heater unit is operable to introduce heated air into a flow of air to the sleeve port.

10. The patient support apparatus of claim 1, wherein the compression module carries a cooler unit in the second interior region and the cooler unit is operable to introduce cooled air into a flow of air to the sleeve port.

11. The patient support apparatus of claim 1, wherein the footboard carries a cooler unit in the first interior region and the cooler unit is operable to introduce cooled air into a flow of air to the sleeve port.

12. The patient support apparatus of claim 1, wherein software for interfacing with the compression module is stored in memory of the control circuitry prior to installation of the compression module in the footboard.

13. The patient support apparatus of claim 1, wherein software for interfacing with the compression module is stored in memory of the compression module and the compression module transmits the software to the control circuitry after installation of the compression module on the footboard.

14. The patient support apparatus of claim 1, wherein the control circuitry downloads software for interfacing with the compression module from a remote computer after determining a type of the compression module that is installed in the footboard.

15. A patient support apparatus for use with a plurality of compression modules of different types, the patient support apparatus comprising a frame including a patient support deck, control circuitry carried by the frame, a footboard coupled to the frame and having a first interior region, the first interior region including a space in which each one of the plurality of compression modules is installable, the space being sized such that only one installed compression module of the plurality of compression modules is able to fit in the space at any given time, and a sleeve port pneumatically coupled to the installed compression module, the sleeve port being configured for attachment to at least one tube extending from a compression sleeve that is worn on a limb of a patient, wherein the control circuitry determines which type of compression module corresponds to the installed compression module and uses module software associated with the installed compression module and does not use other software associated with each of the other compressions modules of the plurality of compression modules that are not installed in the footboard.

16. The patient support apparatus of claim 15, wherein software for each type of compression module of the plurality of compression modules is stored in memory of the control circuitry prior to installation of any of the compression modules of the plurality of compression modules in the footboard and wherein the control circuitry uses the software associated with the installed compression module after determining which type of compression module corresponds to the installed compression module.

17. The patient support apparatus of claim 15, wherein software for each type of compression module of the plurality of compression modules is stored in memory of the respective compression module and the installed compression module transmits the software to the control circuitry after installation.

18. The patient support apparatus of claim 15, wherein the control circuitry downloads the software for the installed compression module from a remote computer after determining the type of compression module is installed in the footboard.

19. The patient support apparatus of claim 15, wherein at least one compression module of the plurality of compression modules carries a heater unit that is operable to introduce heated air into a flow of air to the sleeve port.

20. The patient support apparatus of claim 15, wherein the footboard carries a heater unit that is operable to introduce heated air into a flow of air to the sleeve port.

21. The patient support apparatus of claim 15, wherein at least one compression module of the plurality of compression modules carries a cooler unit that is operable to introduce cooled air into a flow of air to the sleeve port.

22. The patient support apparatus of claim 15, wherein the footboard carries a cooler unit that is operable to introduce cooled air into a flow of air to the sleeve port.

23. The patient support apparatus of claim 15, wherein the compression module receives power wirelessly from the patient support apparatus.

24. The patient support apparatus of claim 23, wherein the compression module includes a first coil, the control circuitry is coupled to a second coil, and the first and second coils are inductively coupled to provide the power wirelessly to the compression module.

25. The patient support apparatus of claim 15, wherein the compression module communicates wirelessly with the control circuitry of the patient support apparatus.

26. The patient support apparatus of claim 25, wherein the compression module includes a first transceiver, the control circuitry is coupled to a second transceiver, and the first and second transceivers are communicatively coupled to provide wireless communication between the compression module and the control circuitry.

27. The patient support apparatus of claim 15, wherein the compression module receives data and power wirelessly from the patient support apparatus.

28. The patient support apparatus of claim 27, wherein the module includes a first coil, the control circuitry is coupled to a second coil, and the first and second coils are inductively coupled to provide the data and power wirelessly to the compression module.

29. A patient support apparatus comprising a frame including a patient support deck, control circuitry carried by the frame, a footboard coupled to the frame and having a first interior region, a compression module located within an interior region of the footboard, the compression module having a housing and a second interior region in the housing, the second interior region being in pneumatic communication with the first interior region through at least one first opening in the housing, wherein software for interfacing with the compression module is stored in memory of the compression module and the compression module transmits the software to the control circuitry after installation of the compression module on the footboard, a sleeve port pneumatically coupled to the compression module, the sleeve port being configured for attachment to at least one tube extending from a compression sleeve that is worn on a limb of a patient, and an electrical cable providing wired communication between the compression module and the control circuitry, the electrical cable extending through a second opening formed in the footboard, wherein during operation of the compression module to inflate the compression sleeve, air moves from ambient surroundings into the first interior region of the footboard through the second opening and air moves into the second interior region in the housing of the compression module through the at least one first opening.

* * * * *